US006442368B1

(12) United States Patent
Ohtsuka et al.

(10) Patent No.: US 6,442,368 B1
(45) Date of Patent: Aug. 27, 2002

(54) FINISHING TECHNOLOGY IN IMAGE FORMING SYSTEM

(75) Inventors: Masari Ohtsuka; Kimikazu Saitoh; Tetsuhiro Kodera; Seitaro Kasahara; Akitoshi Matsubara, all of Tokyo (JP)

(73) Assignee: Konica Corporation, Tokyo (JP)

( * ) Notice: Subject to any disclaimer, the term of this patent is extended or adjusted under 35 U.S.C. 154(b) by 11 days.

(21) Appl. No.: 09/613,432

(22) Filed: Jul. 10, 2000

(30) Foreign Application Priority Data

Jul. 14, 1999 (JP) ..... 11-200131

(51) Int. Cl.[7] ..... G03G 15/00
(52) U.S. Cl. ..... 399/382
(58) Field of Search ..... 399/382, 16, 364, 399/82, 83, 403, 404, 407

(56) References Cited

U.S. PATENT DOCUMENTS

| | | | | |
|---|---|---|---|---|
| 5,257,082 A | | 10/1993 | Kobayashi et al. | |
| 5,272,511 A | * | 12/1993 | Conrad et al. | 270/58.08 |
| 5,489,969 A | * | 2/1996 | Soler et al. | 270/58.02 |
| 5,596,389 A | * | 1/1997 | Dumas et al. | 399/16 |
| 5,713,061 A | | 1/1998 | Yoshioka | |
| 5,839,045 A | * | 11/1998 | Wierszewski | 399/382 |

FOREIGN PATENT DOCUMENTS

JP 60-183459 9/1985

OTHER PUBLICATIONS

Patent Abstracts of Japan, vol. 2000, No. 17, Jun. 5, 2001 and JP 09–124222 A (Xerox Corp.), May 13, 1996.
Patent Abstracts of Japan, vol. 013, No. 223 (M–829), May 24, 1989 and JP 01–038373 A (Konica Corp.), Feb. 8, 1989.

* cited by examiner

*Primary Examiner*—Robert Beatty
(74) *Attorney, Agent, or Firm*—Frishauf, Holtz, Goodman & Chick, P.C.

(57) ABSTRACT

A finishing apparatus is provided which includes a stacker for stacking recording sheets; a first and second conveyor for conveying a recording sheet to an image forming apparatus; a sheet accommodating device for accommodating a sheet to be inserted at an insertion position which is at least one of the top of, the bottom of or a middle portion between the recording sheets; a sheet feeder for feeding the sheet accommodated in the sheet accommodating device to the stacker; an input device for designating the insertion position of the sheet; and a finishing controller for controlling the sheet feeder so that the sheet to be inserted into the recording sheets is stopped and thereafter reconveyed. The feeding interval between the first and second conveyors is made larger when a sheet is inserted between recording sheets.

6 Claims, 13 Drawing Sheets

BASIC IMAGE PLANE
APPLIED FUNCTION
AP2

APPLIED IMAGE PLANE
SHEET INSERTION MODE
AP3

AP1
SHEET INSERTION MODE
SELECT FRONT SHEET/REAR SHEET/PARTITION SHEET
FRONT SIDE
P. 2
P. 12
REAR SIDE
DELETE
SET
CANCEL
OK
AP4
AP5
AP6
AP7
AP8
AP9

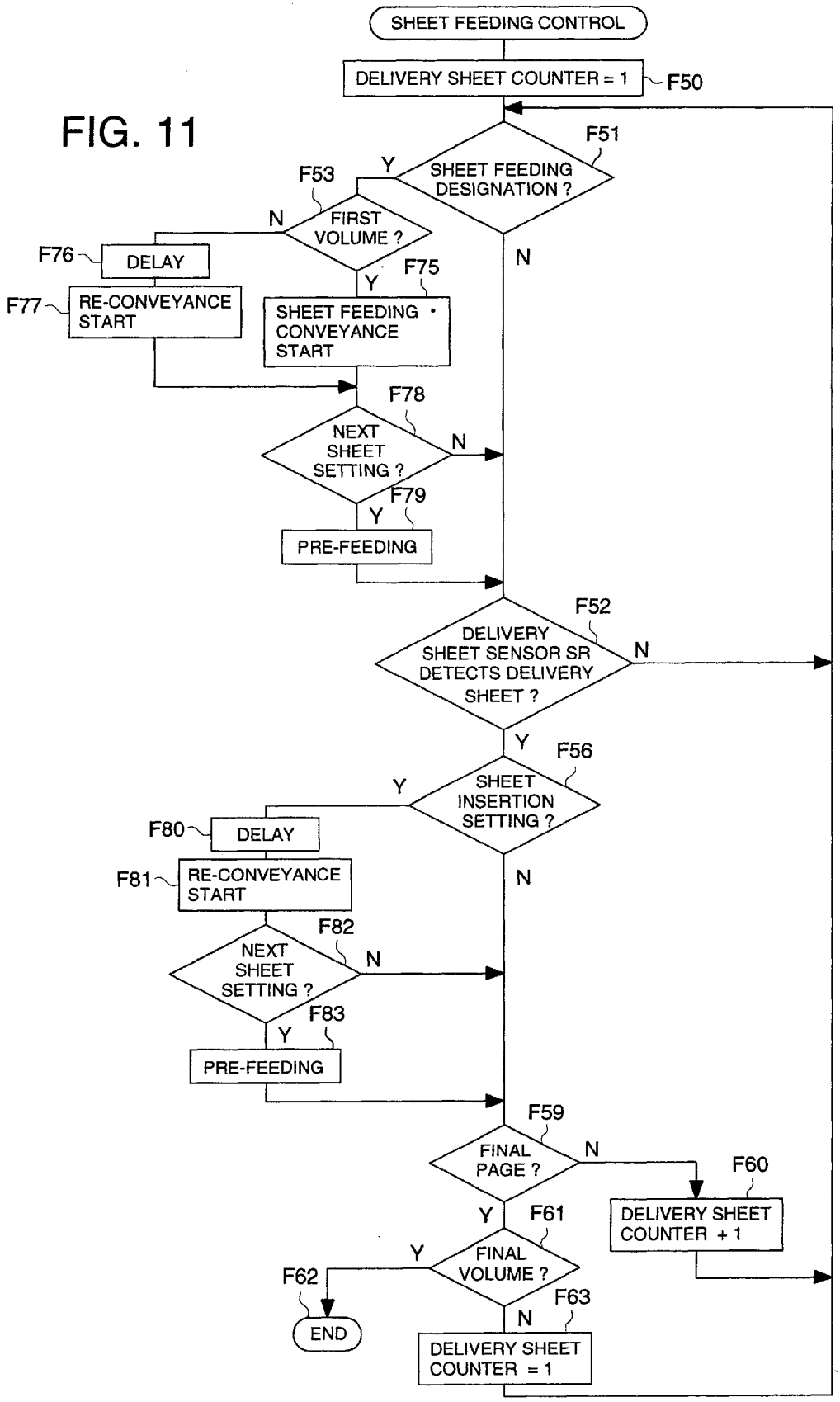
FIG. 11
SHEET FEEDING CONTROL
DELIVERY SHEET COUNTER = 1
F50
F51
SHEET FEEDING DESIGNATION ?
Y
N
F53
FIRST VOLUME ?
N
Y
F76
DELAY
F77
RE-CONVEYANCE START
F75
SHEET FEEDING CONVEYANCE START
F78
NEXT SHEET SETTING ?
N
Y
F79
PRE-FEEDING
F52
DELIVERY SHEET SENSOR SR DETECTS DELIVERY SHEET ?
N
Y
F56
SHEET INSERTION SETTING ?
Y
N
F80
DELAY
F81
RE-CONVEYANCE START
F82
NEXT SHEET SETTING ?
N
Y
F83
PRE-FEEDING
F59
FINAL PAGE ?
N
F60
DELIVERY SHEET COUNTER + 1
Y
F61
FINAL VOLUME ?
Y
F62
END
N
F63
DELIVERY SHEET COUNTER = 1

FINISHING TECHNOLOGY IN IMAGE FORMING SYSTEM

BACKGROUND OF THE INVENTION

The present invention relates to a finishing technology in an image forming system by which a finishing is conducted in such a manner that a front sheet (called also a front cover) and a rear sheet (called also a rear cover) are inserted on the upper and lower side of a bundle of recording sheets on which images are formed, or a partition sheet is inserted between bundles of recording sheets.

As the finishing technology as described above, there is a technology disclosed in Japanese Tokkaisho No. 60-183459. In the technology disclosed in this official publication, the recording sheets delivered from the image forming apparatus are stacked on a stacking means. On the one hand, the sheets such as a front sheet, rear sheet, and partition sheet, are sent into the recording sheet conveyance path at a midway of the recording sheet conveyance path, and conveyed to the stacking means, and placed on upper and lower side of recording sheets. Further, the bundles of the recording sheets and sheets, stacked on the stacking means, are conveyed to the finishing section, and processed by stapling or punching.

In the finishing apparatus described in Japanese Tokkaisho No. 60-183459, because the processing from the image formation to the finishing is not systematized, when the finishing apparatus is used for, for example, a network printer, or high speed digital copier, there are disadvantages that its function is insufficient, and not appropriate for practical use. More specifically, this prior art finishing apparatus is very disadvantageous in the following points:

(1) The processing to insert the sheet into recording sheets, can not be conducted. Further, the insertion position when the sheet is inserted and the number of insertion sheets cannot be arbitrarily set.

(2) In an image recording operation which inserts the sheets into the recording sheets, the conveyance of the recording sheets and the inserting sheets in the finishing apparatus is not stably conducted, and conveyance failure or jamming easily occurs.

(3) Because the processing when the inserting sheet becomes insufficient is not satisfactory, when a shortage of inserting sheets occurs, image formation is stopped during the job.

(4) Because there is no function to use various sized or kinds of sheets, appropriate sheets can not always be used.

OBJECT OF THE INVENTION

Accordingly, the object of the present invention is to solve the various problems described above and to provide a finishing apparatus and an image forming system having a high reliability, a high usability, and adaptability for a serial system for image formation and finishing.

BRIEF DESCRIPTION OF THE DRAWINGS

FIG. 11 is a flow chart showing the control of the second conveyance means in Embodiment 3.

DETAILED DESCRIPTION OF THE PREFERRED EMBODIMENT (1) Embodiment 1

Figure 1:
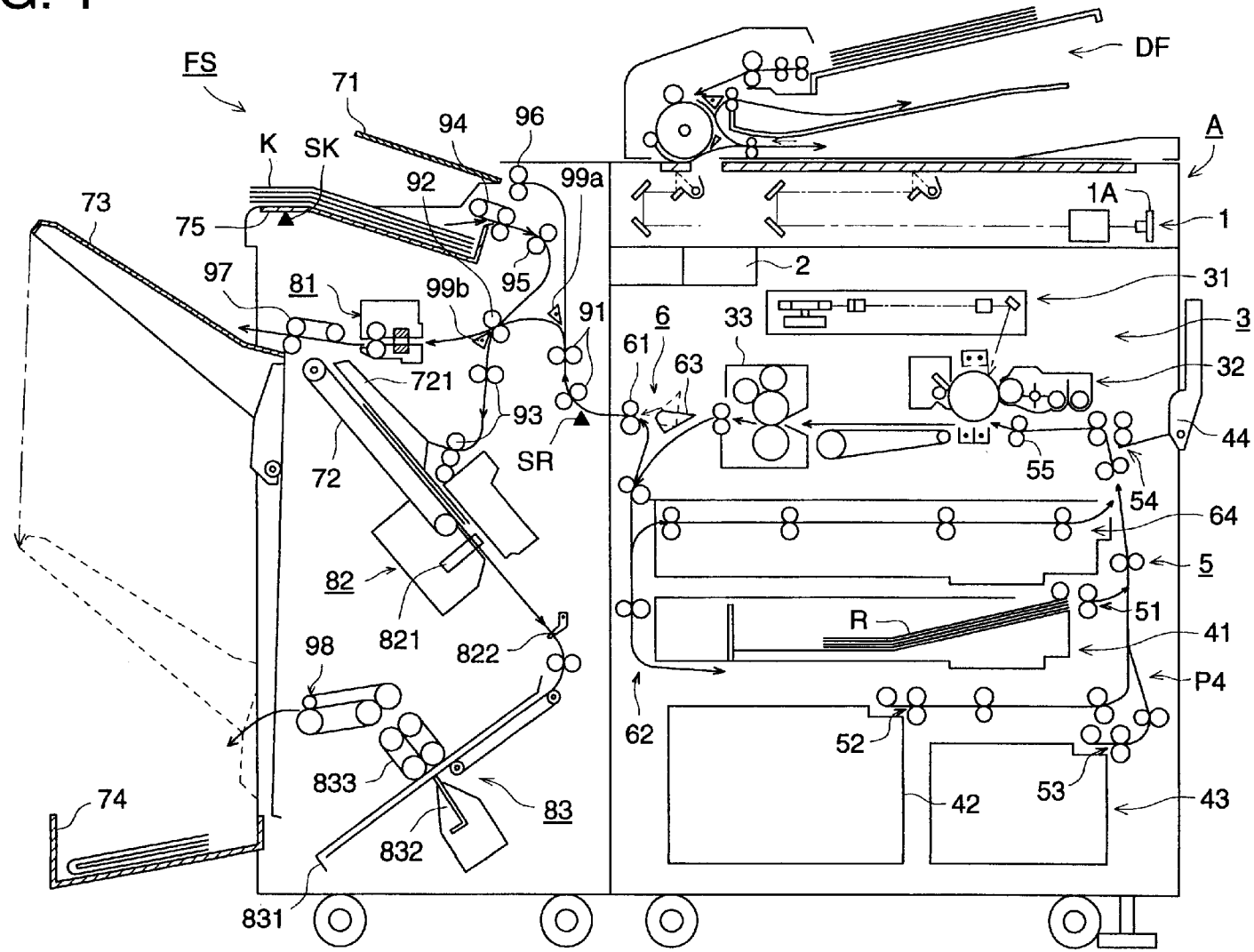
FIG. 1 is an overall structural view of an image forming system.

Referring to FIG. 1, an outline structure of an image forming system will be described. FIG. 1 is the overall structural view of the image forming system.

The image forming system has an image forming apparatus A for forming an image on the recording sheet P, and a finishing apparatus FS for conducting the finishing such as insertion of the sheet K of a front sheet, separation sheet, or rear sheet into the recording sheets image formed by the image forming apparatus A. In FIG. 1, the finishing apparatus FS is connected to the left side of the image forming apparatus A. Incidentally, the finishing apparatus FS in the present embodiment can conduct various finishing such as stapling, shift processing, and folding processing, as the finishing, other than the insertion of the sheet K.

Initially, the image forming apparatus A is an apparatus to form an image on a recording sheet R, and in the present embodiment, an apparatus to form an image by an electrophotographic system, which is publicly known, and an automatic document feeding apparatus DF is mounted on the upper portion of the image forming apparatus A. Further, the image forming apparatus A is provided with: an image reading means 1; an image processing means 2; an image forming means 3; a recording sheet accommodating means 4; a sheet feeding means 5; and a reversing·delivery means 6.

The automatic document feeding apparatus DF is an apparatus by which the documents placed on a platen (without numerical sign), is separated by one by one sheet, conveyed to an image reading position, and delivered onto a delivery stand (without numerical sign). This automatic document feeding apparatus DF is also structured such that, after the document is conveyed to the image reading position, the front and rear sides of the document sheet are reversed, and the document sheet is conveyed again to the image reading position, and can be delivered onto the delivery stand, and only one side of the document or two sides of the document can be read out by the image reading means 1, which will be described later. Incidentally, the automatic document feeding apparatus DF in the present embodiment is structure such that the document is conveyed on the image reading position, and by the image reading means 1, which will be described later, the image of the document which is being conveyed, is read out, however, the conveyed document is stopped once, and the stationary document may be read out.

Image reading means 1 is a means for reading the image of the document, and for obtaining the image data, and in the present embodiment, a means for reading the image of the document conveyed by the automatic document feeding apparatus DF. That is, the document conveyed by the automatic document feeding apparatus DF is photo-electrically converted by a CCD (image sensor) 1A which is an image pick-up means, through a stationary optical system (without numerical sign), and the image data of the document is obtained. Incidentally, as described above, the image data of the stationary document may be obtained while the optical system is being moved. Further, in the present embodiment, the image forming apparatus A is provided with the image reading means 1, however, the image forming apparatus may not have the image reading means 1, and may be connected to a personal computer through a network and a cable, and obtain the data from the personal computer, and the image may be formed.

The image processing means 2 is a means for conducting analog processing, A/D conversion, shading correction, image compression processing, etc., on the analog signal photo-electrically converted by the CCD image sensor 1A, and after the image processing by the image processing means 2, through a storing means (memory) AM for storing the image data at need, it sends the signal to an image writing section 31 of the image forming means 3.

The image forming means 3 is a means for forming the image on a recording sheet R, and in the present embodiment, a means for forming the image by the well-known electrophotographic system. The image forming means 3 has an image writing section 31 and image forming section 32 and fixing section 33. The image wring section 31 is read out by the image reading means 1, and is a means, according to the image data image processed by the image processing means 2, for exposing onto the photoreceptor drum (without numerical sign) of the image forming section 32, which will be described later, and forming the latent image of the image.

That is, the outputted light beam from a semiconductor laser (without numerical sign) according to the image data is irradiated onto the photoreceptor drum of the image forming section 32, and the latent image is formed. On the one hand, the image forming section 32 conducts the processing such as charging, exposing(this is conducted by the image wring section 31), developing, on the photoreceptor drum, and the toner image is formed on the photoreceptor drum, and the toner image is transferred onto the recording sheet R which is conveyed separately and the recording sheet R is separated from the photoreceptor drum, and the remained toner on the photoreceptor drum after the separation is cleaned. The fixing section 33 is a means for fixing the toner image transferred onto the recording sheet R by the image forming section 32.

The recording sheet accommodating means 4 is a means for accommodating the recording sheet R onto which the image is to be formed by the image forming means 3, and in the present embodiment, it has a plurality of recording sheet accommodating means such as a tray 41, a large capacity tray (LCT) 42, 43, and hand feeding tray 44.

The sheet feeding means 5 is a means for sending the recording sheet from one of a plurality of recording sheet accommodating means one by one sheet, and for feeding to the image forming means 3. This sheet feeding means 5 is provided corresponding to each of recording sheet accommodating means 41–44, and has the first sheet feeding means 51–54 for sending the recording sheet R from each of recording sheet accommodating means 41–44, and the second sheet feeding means (also called register roller) for conveying the recording sheet R sent from the first sheet feeding means 51–54 to the image forming means 3. The recording sheet R accommodated in the recording sheet accommodating means 41–44, by the first sheet feeding means 51–54, is separated one by one sheet (in FIG. 1, through the roller as an intermediate sheet feeding means), and conveyed to the second sheet feeding means 55, and in the second sheet feeding means 55, the leading edge of the recording sheet R is stopped once by the second sheet feeding means 55, and is in timed relationship with the toner image on the photoreceptor drum formed by the image forming means 3 and re-feeding of the recording sheet is started, and the recording sheet is conveyed to the transfer position of the image forming means 3. Then, at the transfer position, the toner image on the photoreceptor drum is transferred onto the recording sheet R and the image is formed.

The reversing·delivering means 6 is a means which is commonly used for a delivery sheet means for delivering the recording sheet R on which the toner image is fixed outside the image forming apparatus A, a reversal delivery sheet means for reversing and delivering the recording sheet R, and reversing means for reversing the front and rear sides of the recording sheet R and for conveying the recording sheet R to the image forming means 3 again (through the second sheet feeding means 55). This reversing·delivering means 6 has: a delivery sheet roller 61 for delivering the recording sheet R to the outside of the image forming apparatus A; a reversing section 62 to reverse the front and rear sides of the recording sheet R; a switching section 63 to switch the paths for conveying the recording sheet R sent from the fixing section 33 to the sheet feed roller side 61 or to the reversing section 62 side; and a conveyance section 64 to convey the recording sheet R reversed by the reversing section 62 to the image forming means 3 again. Then, when the recording sheet R on which the toner image is fixed, is delivered as it is, the recording sheet R is guided to the delivery roller 61 side by the switching main portion 63 (in FIG. 1, a position of the solid line), and conveyed to the outside of the image forming apparatus A, that is, to the finishing apparatus FS side. Further, when the front and rear side s of the recording sheet R on which the toner image is fixed is reversed and the recording sheet R is delivered, after the recording sheet R is guided to the reversing side 62 side once by the switching main section 63 (in FIG. 1, a position of the dotted line), and is conveyed, the advancing direction is reversed, and conveyed to the delivery sheet roller 61 side, and conveyed to the outside of the image forming apparatus A. Further, when the image is formed on the rear side of the recording sheet R on which the toner image is fixed, after the recording sheet R is guided to the reversing side 62 side by the switching main section 63 (in FIG. 1, a position of the dotted line), and conveyed, the advancing direction is reversed, and conveyed toward the upstream side of the conveyance direction of the second sheet feeding section 55, and in the same manner as described above, by the image forming means 3, the image is formed on the rear side.

Further, the finishing apparatus FS will be described below. The finishing apparatus FS receives the image formed recording sheet R delivered from the image forming apparatus A one by one sheet, and is an apparatus by which the front sheet K, rear sheet K, or partition sheet K is inserted onto the upper side, lower side, or between a pair of the recording sheets R. Further, the finishing apparatus FS in the present embodiment is an apparatus which can conducts finishing such as staple (stapling) processing (center stapling can also be processed), shift processing, or center staple processing. This finishing apparatus FS has a main body delivery sheet tray 71 on which the recording sheet R delivered from the image forming apparatus A is stacked; stacking section 72; elevating delivery sheet tray 73; and fixed delivery sheet tray 74; sheet accommodating means 75; shift means 81 as the finishing means; staple means 82; center folding means 83; and conveyance means for conveying the recording sheet R or sheet K. From the upper side in FIG. 1, the main body delivery sheet tray 71, sheet accommodating means 75, shift means 81, stacking section 72, staple means 82, and center folding means 83, are arranged almost vertically.

The main body delivery sheet tray 71 is a means onto which, when the recording sheet R delivered (sent) from the image forming apparatus A is delivered while the insertion of the sheet K, shift processing, staple processing or folding processing are not conducted, the delivery recording sheet R is stacked. The stacking section 72 is a stacking means for stacking the recording sheet R delivered from the image forming apparatus A, or further, the sheet K conveyed from the sheet accommodating means 75, and in the present embodiment, it is also a means for stacking them for staple processing by the staple means 82. Further, in the present embodiment, this stacking section 72 is structured by a belt (without numerical sign) stretched between a pair of rollers (without numerical sign), so that the stapled recording sheet R, or further, a bundle of sheets K can be conveyed to the elevating delivery sheet tray 73 side, or the center folding means 83 side. Further, in this stacking section 72, a regulation plate 721 which reciprocates in the direction perpendicular to the drawing in FIG. 1 is provided, and every time when the recording sheet R or further, the sheet K is stacked on the stacking section 72, the plate 721 reciprocates and aligns the recording sheet R, or further, sheet K on the stacking section 72. The elevating delivery sheet tray 73 is a stacking means for stacking the recording sheet R which is shift processed by the shift means 81, or further, sheet K, and has a movement mechanism, not shown, and by the movement means, it can move upward and downward as shown in FIG. 1. Incidentally, in the present embodiment, this elevating delivery sheet tray 73 is also a means for stacking the recording sheet R which is stapled processed by the staple means 82, or further, sheet K. The fixed delivery sheet tray 74 is a means for stacking the recording sheet R which is folding processed by the center folding means 83, or further, sheet K.

The sheet accommodating means 75 is a means for accommodating the sheet K used for the front sheet, partition sheet, or rear sheet. This sheet accommodating means 75 is provided in the finishing apparatus FS main body, and is structured so that the user can place the sheet K, or replace it.

The shift means 81 is a means for shifting the recording sheet R, or further sheet K in the direction perpendicular to the conveyance direction (in FIG. 1, in the direction perpendicular to the drawing). When the recording sheet R delivered from the image forming apparatus A is passed, the shift processing in which the shift amount is changed, is conducted for each volume, or for each job by this shift means 81, and the recording sheet is delivered onto the elevating delivery sheet tray 73, thereby, the end portion for each volume, or each job can be easily noticed to the user, and the mixture of the recording sheet R between volumes, or jobs, can be prevented.

The staple means 82 is a means for stapling (staple) a bundle of the recording sheets R stacked on the stacking section 72, or further, a bundle of the sheets K. In the present embodiment, the lower end portion of the recording sheet R conveyed onto the stacking section 72, or further, the sheet K is aligned by a stopper 821, further, arranged in the direction perpendicular to the drawing by the regulation plate 721, and when a predetermined number of sheets (one volume) are stacked, these are stapled by the staple means 82. Incidentally, in the present embodiment, the following structure is adopted: not only the end portion of the bundle of the recording sheets R regulated by the stopper 821 is stapled by the staple means 82, but also the central portion of the bundle of the recording sheets R whose end portions are regulated by the stopper 822, can be stapled by the staple means 82 (so-called center-stapling).

The center folding means 83 is a means by which a bundle which is center-stapled by the staple means 82 and conveyed, is center-folded. This center folding means has a stopper 831 to regulates the leading edge of the conveyed bundle, a protruding portion 832 to protrude the central portion of the bundle which is held and regulated at a predetermined position by the stopper 831, and a pair of belts/rollers 833 to pressure-contact and convey the bundle of sheets which are protruded by the protruding portion 832 and folded in two, and conducts the center-folding processing.

The conveyance means in the finishing apparatus FS has: a conveyance roller 91 to convey the recording sheet R delivered from the image forming apparatus A; a conveyance roller 92 to convey the recording sheet R sent by the conveyance roller 91; a conveyance roller 93 to convey the recording sheet R sent by the conveyance roller 92 to the stacking section 72; a sheet feeding roller 94 to send out the sheet K accommodated in the sheet accommodating means 75 one by one sheet, a conveyance roller 95 to convey the sheet K sent out by the sheet feeding roller 94 to the conveyance roller 92; a main body delivery sheet roller 96 to deliver the recording sheet R sent by the conveyance roller 91 onto the main body delivery sheet tray 71; an elevating delivery sheet roller 97 to deliver the recording sheet R which is shift processed by the shift means 81, or the recording sheet R which is staple processed by the staple means 82 onto the elevating delivery sheet tray 73; and a fixed delivery sheet roller 98 to deliver the recording sheet R which is center-folding processed by the center center folding means onto the fixed delivery sheet tray 74, and as shown in FIG. 1, the conveyance means conveys the recording sheet R or sheet K in the arrowed direction. Incidentally, the first switching section 99*a* is a means for switching the conveyance path of the recording sheet R conveyed by the conveyance roller 91 to the conveyance roller 92 side, or the main body delivery sheet roller 96 side, and the second switching section 99*b* is a means for switching the conveyance path of the recording sheet R conveyed by the conveyance roller 92, or the sheet K, to the conveyance roller 93 side, or the shift means 81 side.

Herein, when the staple processing is conducted by the staple means 82 of the finishing apparatus FS, the conveyance rollers 91–93 structures the first conveyance means for conveying the recording sheet R delivered from the image forming apparatus A to the stacking portion 72, and the sheet supplying roller 94, conveyance rollers 95, 92, and 93 structure the-second conveyance means for conveying the sheet K accommodated in the sheet accommodating means 75 to the stacking section 72. In the present embodiment, the first conveyance means and the second conveyance means commonly use the conveyance rollers 92 and 93, and the conveyance path of the sheet K by the second conveyance means joins in the middle of the conveyance path of the recording sheet R by the first conveyance means, that is, in the vicinity of the conveyance roller 92, and the subsequent path is common to each other.

Further, when the shift processing is conducted in the shift means 81 of the finishing apparatus FS, the conveyance rollers 91, 92, and elevating delivery sheet roller 97 structure the fist conveyance means for conveying the recording sheet R delivered from the image forming apparatus A onto the elevating delivery sheet tray 73, and the sheet supplying roller 94, conveyance rollers 95, 92, and elevating delivery sheet roller 97 structure the second conveyance means for conveying the sheet K accommodated in the sheet accommodating means 75 onto the elevating delivery sheet tray 73. In the present embodiment, the first conveyance means and the second conveyance means commonly uses the conveyance roller 92, and elevating delivery sheet roller 97, and the conveyance path of the sheet K by the second conveyance means joins in the middle of the conveyance path of the recording sheet R by the first conveyance means, that is, in the vicinity of the conveyance roller 92, and the subsequent path to this, is common to each other.

As described above, in the present embodiment, because the conveyance path of the sheet K by the second conveyance means joins in the middle of the conveyance path of the recording sheet R by the first conveyance means, and the subsequent path is common to each other, thereby, a portion of the first conveyance means and the second conveyance means can be commonly used, and the cost reduction and space reduction can be realized.

Incidentally, a sheet sensor SK which is a sheet detection means for detecting the existence of the sheet accommodated in the sheet accommodating means 75 of the finishing apparatus FS, is provided. As this sheet sensor SK, various sensors such as an optical sensor or a micro switch, can be used. Incidentally, in the present embodiment, the sheet sensor K is provided such that it detects the trailing edge side of the sheet supplying direction of the sheet accommodated in the sheet accommodating means 75, and is structured so that, even while the sheet K is conveyed by the sheet supplying operation (a condition that the overall of the sheets K are not supplied from the sheet accommodating means 75), the existence of the next sheet K can be detected early. Incidentally, when a plurality of sheet sensors SK are provided, not only these sensors SK can be functioned as the sheet size detection means, but also, even when the sheet k is any size, the detection of the existence of the next sheet K can be conducted early.

Further, in the present embodiment, in order to detect the conveyance condition of the recording sheet R in the finishing apparatus FS, and as will be described later, to determine the conveyance timing of the sheet K, a delivery sheet sensor SR which is a detection means for detecting the conveyance of the recording sheet R (in other word, the delivery sheet of the recording sheet R from the image forming apparatus A) is provided at the entry side of the conveyance path of the recording sheet R by the first conveyance means (91–93) in the finishing apparatus FS. This delivery sheet sensor SR is provided in the finishing apparatus FS in the present embodiment, however, it may be provided in the image forming apparatus A or between the finishing apparatus FS and the image forming apparatus A.

Figure 2:
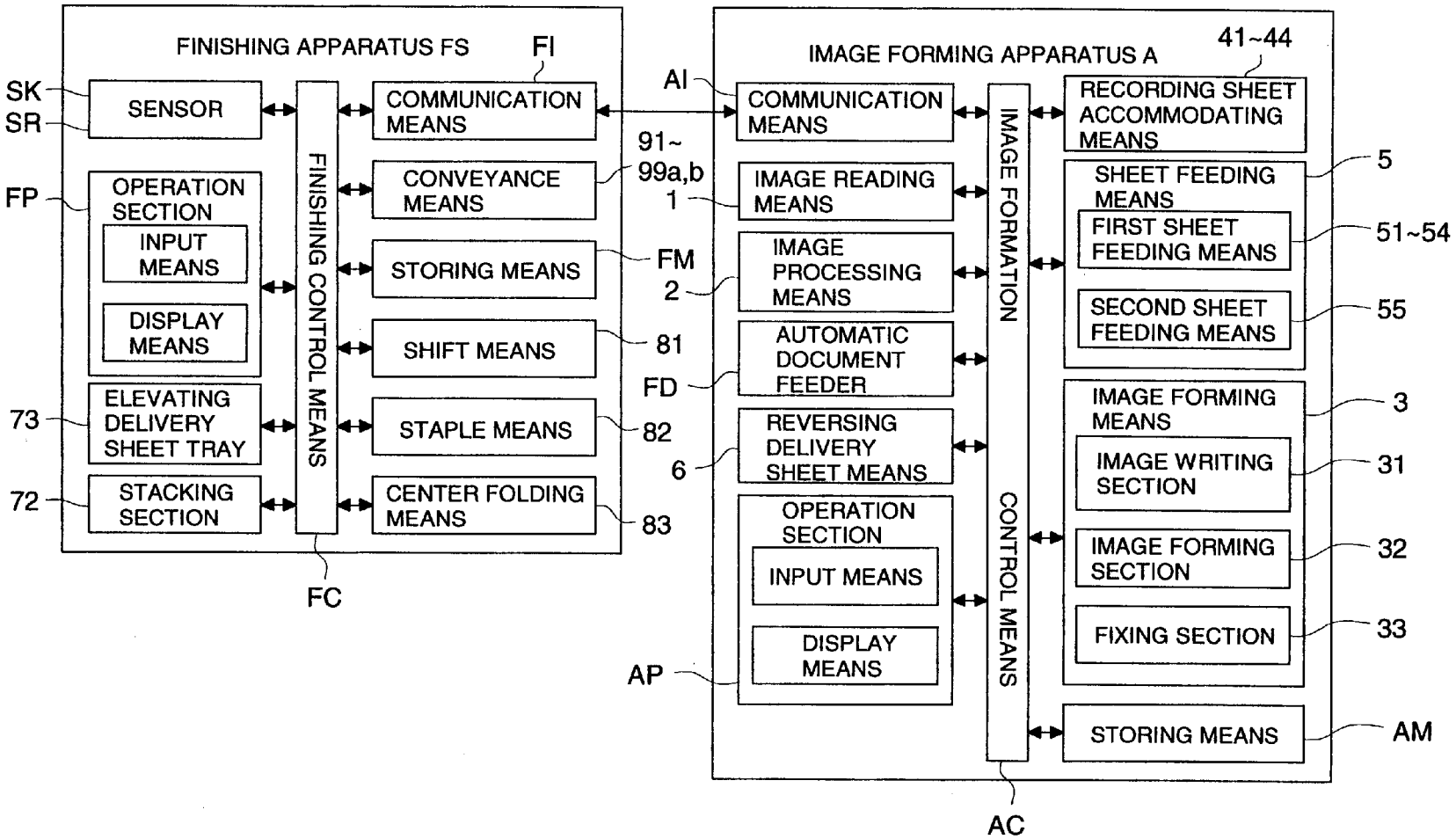
FIG. 2 is a control block diagram of the image forming system.

FIG. 2 is a control block diagram of the image forming system in the present embodiment.

The image forming apparatus A is controlled by an image formation control means AC to control each means of the image reading means 1, image processing means 2, image forming means 3, recording sheet accommodating means 4, and reversing·delivery sheet means 6. Further, the image formation control means AC is structured so that an operation section AP, memory means AM, and communication means AI, which are not described above, are also controlled. The operation section AP is a user interface to set various modes by the image forming apparatus A, and to input and display the designation of the start of the image formation, and as will be described later, it has an input means to receive the input from the user and a display means to display the result and the operation of the image forming apparatus A, and is structured by a touch panel or the like, which is integrated with these means. Further, the storing means AM is a storing means for storing the various information such as the information inputted from the input means, and the image data read out by the image reading means 1. Further, the communication means AI is a means for transmitting (transferring) the information between the image formation control means AC and the finishing control means FC, through the communication means FI of the finishing apparatus FS.

The finishing apparatus FS is controlled by the finishing control means FC to control each means of the above stacking section 72, elevating delivery sheet tray 73, shift means 81, staple means 82, center folding means 83, sheet detection means SK, conveyance means 91–98, 99*a*, 99*b*. Further, the finishing control means FC is structured so that an operation section FP, storing means FM, and communication means FI, which are not described above, are also controlled. The operation section FP is a user interface to input and display the setting of various modes by the finishing apparatus FC, and to input and display the designation of the start of the image formation, and as will be described later, it has an input means to receive the input from the user and a display means to display the result. Further, the storing means FM is a storing means for storing the various information such as the information inputted from the input means. Further, the communication means FI is a means for transmitting (transferring) the information between the image formation control means AC and the finishing control means FC, through the communication means AI of the image forming apparatus FS.

Figure 3:
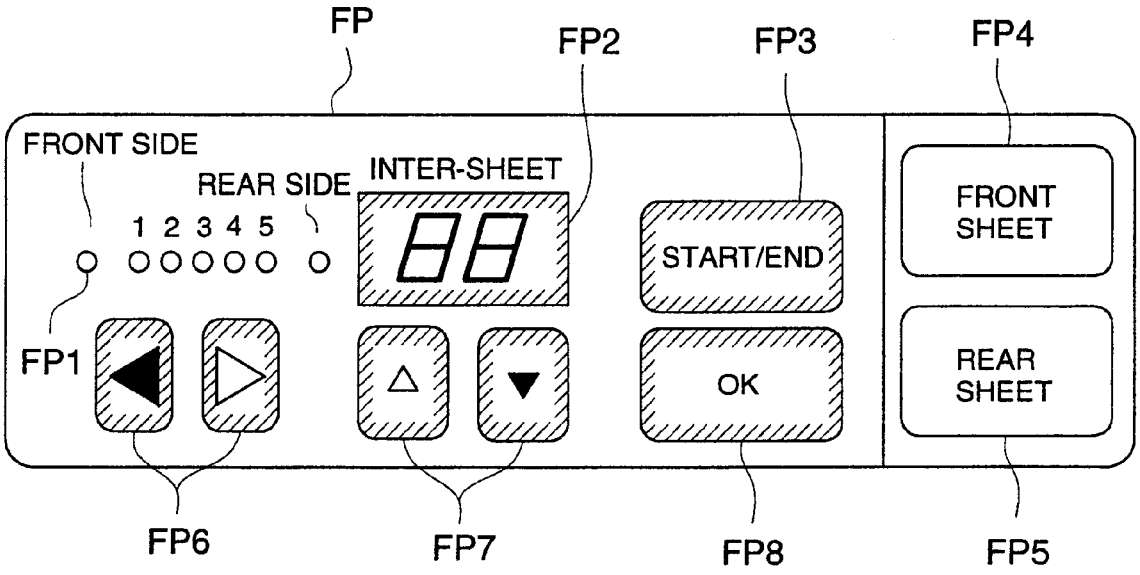
FIG. 3 is a view showing a portion to set an insertion position of an operation section of a finishing apparatus.

Next, the setting (designation·input) of the position to insert the sheet K, will be described. FIG. 3 is a view showing a portion to set the insertion position, of the operation section FP of the finishing apparatus FS. Incidentally, the operation section FP provided in the finishing apparatus FS is structured so that the finishing such as the setting of shift processing, staple processing (including center-staple processing), and center-folding processing, can also be set, however, in FIG. 4, only the setting of the sheet K is described.

The operation section FP of the finishing apparatus FS to set the front sheet K, rear sheet K, and partition sheet K is structured, as shown in FIG. 3, by the display means FP1, FP2, and the input means FP3–FP8, and in the present embodiment, these are respectively structured by a plurality of input means, and display means, however, these may be structured by the touch panel which combines the input means with display means.

The display means FP1 and FP2 are display means for displaying that the sheet K is in the insertion mode, and also for displaying the insertion position of the sheet K. Specifically, the display means FP1 is a display section for displaying the insertion position of the sheet K, which is inputted from the input means FP3–FP8 of the operation section FP and set, or from the input means of the operation section AP of the image forming apparatus A, which will be described later. That is, when the display lamp of a portion described as (front) or (rear) is turned on, it is shown that the insertion of the front sheet K or rear sheet K is set (in other word, the insertion mode of the front sheet K or rear sheet K), and when the display lamp of the numerals described between (front) and (rear) is on, it is respectively shown that the insertion of the first partition sheet K, second partition sheet K, . . . , the fifth partition sheet K, is set (in other word, it is the insertion mode of the partition sheet). Incidentally, when the display lamp is off, the insertion of the partition sheet K is not set, and when the display lamp of the numerals is flickering, it is shown that the insertion position of the partition sheet K (next to what page of the recording sheet R, it is inserted) is being set now. The display means FP2 is a display section for displaying the insertion position of the partition sheet.

The input means FP3–FP8 are input means for designating the insertion position of the sheet K from the finishing apparatus FS side. Specifically, the input means FP3–FP8 are respectively structured by a button to detect the pressing of the user. The start/end button FP3 is an input means for inputting the start/end of the setting of the insertion position of the sheet K. The front sheet K button FP4, and rear sheet K button FP5 are input means for respectively inputting the insertion of the front sheet K, and rear sheet K. Every time when the front sheet K button FP4 and the rear sheet K button FP5 are pressed, the insertion and non-insertion of the front sheet K and the rear sheet K are switched, and according to that, the display lamp of (front) and (rear) of the display means FP1 is switched on and off. The input means composed of the right button and left button FP6 is an input means for inputting the number of sheets of the partition sheets K. The input means composed of the addition button and subtraction button FP7 is an input means for inputting the insertion position of the sheet K at the number designated by the input means FP6. An OK button FP8 is an input means for inputting that the setting of the insertion position, inputted by the input means FP7, of the partition sheet K at the number designated by the input means FP6 is completed. Incidentally, in the present embodiment, the front sheet K button FP4 and the rear sheet K button FP5 are provided, and independently of the setting of the insertion position of the partition sheet K, when the front sheet K button FP4 and the rear sheet K button are pressed, the insertion of the front sheet K and the rear sheet K can be set, however, without being limited to that, in the same manner as the setting of the insertion position of the partition sheet K, which will be described later, the insertion of the front sheet K and the rear sheet K may be set. Further, the insertion position inputted by the input means FP3–FP8 is stored in the storing means FM in FIG. 2, and the information is transmitted through the communication means FI, and AI also to the image forming apparatus A side.

Figure 4:
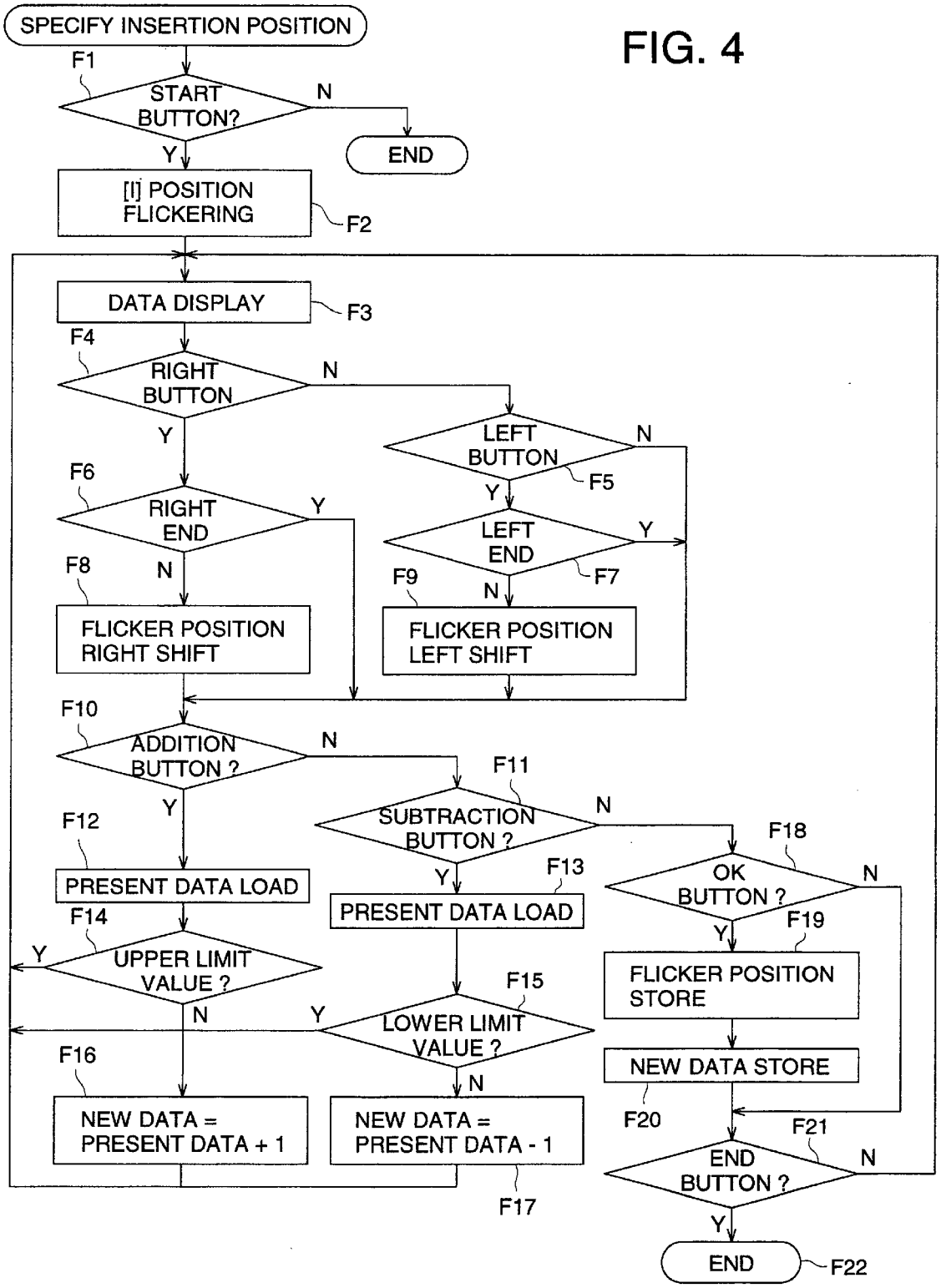
FIG. 4 is a flow chart to specify an insertion position of a sheet K.

Herein, the setting of the insertion position of the partition sheet K will be described, according to FIG. 4, which is a flow chart designating the insertion position of the sheet K.

When the start/end button FP3 is pressed (F1), the display of the display lamp of a position (1) (the first sheet of the partition sheet K) in the display means FP1 flickers (F2). Then, the insertion position of the first sheet of the partition sheet K stored in the storing means FM is read out (loaded), and is displayed on the display means FP2 (F3). According to whether the right button and the left button FP6 is pressed (F4, F5), it is confirmed whether the display lamp respectively flickering in the display means FP1 is the right end, or the left end (F6, F7), and when it is not the end, the flickering position is respectively shifted to the right, or the left (F8, F9). After the shifting is conducted in F8, and F9, or when the right button, or the left button FP6 is not pressed (N in F5), or the flickering position is the right end, or the left end (Y in F6, Y in F7), the sequence advances to the setting of the flickering insertion position of the partition sheet K (F10–F17). In the setting of the insertion position, initially, when either one of the addition button or the subtraction button FP7 is pressed (Y in F10, or Y in F11), the insertion position of the partition sheet K of the number of sheet which is flickering in the display means FP1 is read from the storing means FM (F12, F13), and it is respectively confirmed whether it is the upper limit value or the lower limit value (F14, F15), and the addition and subtraction of +1, −1, are respectively conducted on the insertion position read out in F12, F13, and these are stored in the storing means FM (F16, F17). Then, when the new data (insertion position) obtained by addition and subtraction in F16, F17, is stored in the storing means FM, or when it is the upper limit value, the lower limit value (Y in F14, Y in F15), the sequence returns to F3. On the one hand, when the addition button, the subtraction button FP7 are not pressed in F10, F11, it is confirmed whether the OK button FP8 is pressed or not, and when it is pressed, the flickering position flickering in the display means FP1 and the insertion position displayed on the display means FP2 are stored in the storing means FM (F19, F20). After these are stored in F20, or in the case where the OK button FP8 is not pressed (N in F18), when the start/end button FP3 is pressed (Y in F21), the setting of the insertion position is completed, and when the button is not pressed (N in F21), the sequence returns to F3.

As described above, in the present embodiment, the insertion position of the sheet K can be set by the operation section FP provided in the finishing apparatus FS side, and as will be described later, according to this setting, the conveyance (conveyance by the second conveyance means) of the sheet K is controlled, and when the sheet K is inserted, the insertion position can be arbitrarily set in the finishing apparatus, thereby, the operability is increased. Further, in the present embodiment, not only the conveyance of the sheet K, but the conveyance of the recording sheet R and the image formation are also controlled, and the stable image formation can be conducted. Of course, the information of the insertion position of the sheet K set by the operation section of the finishing apparatus FS is transmitted also to the image forming apparatus A through the communication means FI and AI.

Figure 5:
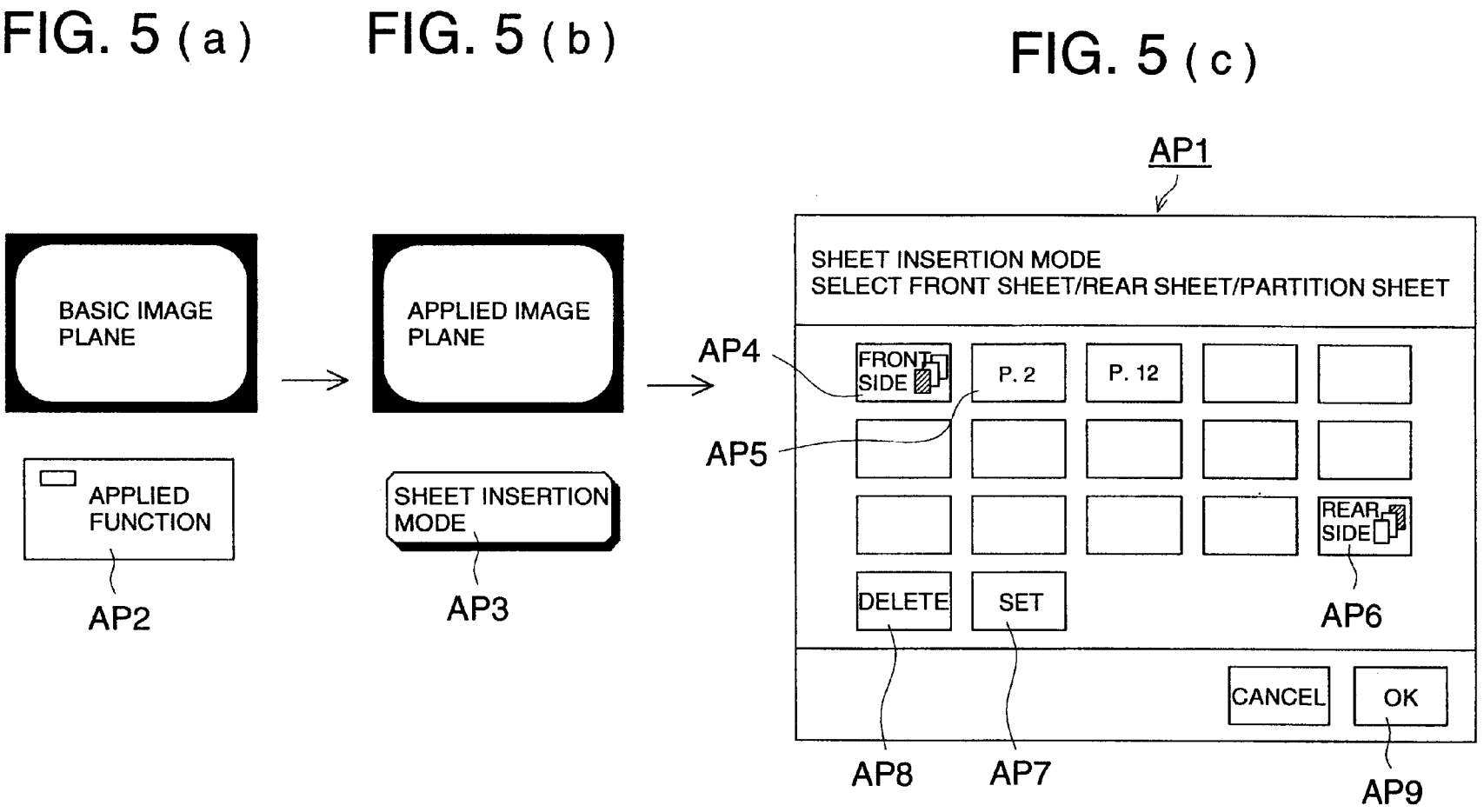
FIGS. 5(*a*), 5(*b*) and 5(*c*) are views showing a portion to set an insertion position of an operation section of an image forming apparatus.

Next, the setting (designation·input) of the position into which the sheet K is inserted, in the image forming apparatus A side, will be described. Incidentally, the operation section AP provided on the image forming apparatus A can set the various setting and input other than this, however, herein, the explanation is omitted, and setting of the insertion position of the sheet K will be described. FIG. 5 is a view showing a portion to which the insertion position is set by the operation section AP of the image forming apparatus A, and herein, the change of the condition of the image plane structured by touch panel AP1 which combines the display means with the input means, is shown.

On a part of the basic image plane of the touch panel AP1, as shown in FIG. 5(*a*), an application function button AP2 is provided, and when this application function button AP2 is pressed by the user, the application image plane is displayed on the touch panel AP1. On this application image plane, as shown in FIG. 5(*b*), a sheet insertion mode button AP3 is provided, and when this button is pressed, as shown in FIG. 5(*c*), the setting image plane of the sheet insertion mode is displayed on the touch panel AP1.

On the setting image plane of the sheet insertion mode, successively from the left upper portion, the set button AP4 of the front sheet K, the set button AP5 of the first sheet, . . . , the set button AP6 of the rear sheet K are provided, and when the respective buttons are pressed in the off-condition, the button flickers, and when the numeric value of the insertion position is inputted from a numeric keys, not shown, the inputted numeric value is displayed on the flickering button. Then, when the set button AP7 is pressed, the set data is stored in the storing means AM of the image recording apparatus A, and the numeric value is displayed on the button portion. Incidentally, the inputs of the numeric values are not necessary for the set buttons AP4 and AP6 of the front sheet K and the rear sheet K, and when the set buttons AP4 and AP6 are pressed, the insertion of the front sheet k and the insertion of the rear sheet K are set. Further, when a delete button AP8 is pressed and any one of the buttons AP4–AP6 is pressed, the sheet K insertion mode is completed. Incidentally, the information of the insertion position of the sheet K set in the operation section AP of the image forming apparatus, is also transmitted to the finishing apparatus FS through the communication means AI and FI.

As described above, in the present embodiment, the insertion position of the sheet K can be set by the-operation section AP provided on the image forming apparatus A side, and the set sheet K position is transmitted to the finishing apparatus FS side through the communication means AI and FI, and as will be described later, according to this set, the conveyance of the sheet K (conveyance by the second conveyance means) is controlled, and when the sheet K is inserted, the insertion position can be arbitrarily set in the finishing apparatus, and the operability is increased, and further, not only the conveyance of the sheet K, but the conveyance of the recording sheet R and the image formation are also controlled, and the stable image formation can be conducted.

Incidentally, in the present embodiment, because the insertion position of the sheet K can be set from either one of the image forming apparatus A or the finishing apparatus FS, the respectively set information is transmitted to the other apparatus through the communication means FI, and AI, and the adjusted information can be displayed in the respective operation section AP or FP.

Next, according to FIG. 6 which is a flow chart showing the control of the first sheet feeding means (51, 52, 53, and 54), the sheet feeding control of the recording sheet R in the present embodiment will be described. Incidentally, the first sheet feeding means 51–54 are driven by the designation of the user from the operation section AP of the image forming apparatus A, or the sheet feeding means corresponding to one recording sheet accommodating means in the recording sheet accommodating means 41–44, designated by APS (automatic Paper selection) from the image formation control means AC is driven. Further; in the present embodiment, in the insertion position of the sheet K set by the operation section AP of the image forming apparatus A or by the operation section FP of the finishing apparatus FS, the partition sheet K is inserted in the next to the page (the same number as the set insertion position) of the recording sheet K, and when the front sheet K is set, the sheet K is inserted in the 0 page, and when the rear sheet K is set, the sheet K is inserted in the next to the final pages.

Initially, when the start of the job (image formation) is designated, 1 is set to the sheet feeding counter, and 0 is set to the insertion flag (F25). This sheet feeding counter is stored in the storing means AM, and is the page number to be image formed. Further, the insertion flag is, as will be described later, a flag to cause the delay in the sheet feeding of the recording sheet R.

Then, it is judged whether it is a sheet feeding timing, or not (F26). In the present embodiment, the sheet feeding timing is generated at a predetermined time interval. For example, when the image forming apparatus A can form the images of 60 sheets per minute, the sheet feeding timing is generated at one second interval. Incidentally, in the present embodiment, the sheet feeding timing may be generated, when the sheet feeding of the recording sheet R, which is previously fed, or the passage at a predetermined position is detected, or after a predetermined time period from the signal.

In F26, when it is the sheet feeding timing, it is judged whether the insertion flag is 1 (F27), and when the insertion flag is 1, the insertion flag is set to 0 (F28), and the sequence returns to F26. Accordingly, when the insertion flag is 1 in F27, a step of F38 is not conducted to the next sheet feeding timing (F26), that is, the sheet feeding timing for one operation time is skipped, and the sheet feeding of the recording sheet R is delayed. On the one hand, when the insertion flag is 0, the first sheet feeding in F38 is conducted corresponding to the condition, which will be described later, and the sheet feeding of the recording sheet R is conducted. The delay of this recording sheet R is conducted, as will be described later, in order to insert the-sheet K between the recording sheets R, so that the interval between the recording sheets R is larger than a case in which the sheet K is not inserted. According to this delay, the conveyance of the recording sheet R and the sheet K in the finishing apparatus FS is stably conducted, thereby, the conveyance failure or jamming of the recording sheet R and the sheet K in the finishing apparatus FS can be prevented.

Next, it is judged whether the sheet feeding counter is 1 (F29), and when the sheet feeding counter is 1, it is judged whether the recording sheet R is the first volume (F30), and when it is the first volume, as described above, it is judged whether the insertion of the front sheet K is set from the operation section FP of the finishing apparatus FS, or the operation section AP of the image forming apparatus A (F31). Then, when the front sheet K is not set (N in F31, that is, when the front sheet K is not set when the first page recording sheet R of the fist volume is fed), the fist sheet feeding in F38 is conducted.

When the recording sheet R is not the first volume in F30, it is judged whether the finishing (such as staple processing by the above-described staple means 82, and hereinafter, the staple processing will be described as the presupposition) is set, and whether the insertion of the rear sheet K is set (F32), and when the finishing is set, a time period necessary for the finishing and/or when the rear sheet K is set, a time period necessary for the insertion of the rear sheet K is delayed (F33). That is, when the necessary time period is delayed, the first page of the next volume of the recording sheet is made not to reach the stacking section 72 during the finishing processing and/or insertion of the rear sheet K.

After that, in F34, as described above, it is judged from the operation section FP of the finishing apparatus FS or the operation section AP of the image forming apparatus A whether the insertion of the front sheet K set. Then, when the front sheet K is set (Y in F34, that is, when the insertion of the front sheet K is set when the first page of the recording sheet R of the second and the subsequent volumes is fed), a predetermined time period is delayed (F35). This delay in F35 is for the reason that, by delaying the time period necessary when the front sheet K is inserted before the first page of the second and the subsequent volumes, the insertion of the front sheet K can be assuredly conducted.

In F31, when the front sheet K is set, or In F35, when a predetermined time period is delayed, it is judged whether the sheet K is further accommodated in the sheet accommodating means 75, that is, whether the sheet K exists (F36). Then, the existence of the sheet K is judged in F36, and when the sheet K exists, the sheet feeding designation is transmitted to the finishing control means FC of the finishing apparatus FS through the communication means AI, and FI (F37).

Herein, when the sheet feeding counter is 1, F29–F37 are specifically considered for the reason that, in the present embodiment, the insertion position set by the operation section FP and AP is determined such that the partition sheet K is inserted next to the set insertion position (the page number of the recording sheet K), and for the rear sheet, the sheet K is inserted next to the final page, and in contrast to that, it is necessary that the front sheet K is inserted before the recording sheet K. Accordingly, when the front sheet K of the first volume is inserted, the sheet feeding designation of the front sheet K is directly given to the finishing apparatus FS (F37). Specifically, when the first page of the second and subsequent volumes is fed, the sheet feeding of the first page of the second and subsequent volumes is delayed so that the interval between the recording sheet of the first page of the second and subsequent volumes and the preceding recording sheet (the final page of the preceding volume), or the rear sheet K (when the insertion of the rear sheet K is set), is more spread, and further, so that the time period necessary for the finishing is assuredly obtained, and the insertion of the front sheet K and the finishing can be surely conducted.

In F29, when the sheet feeding counter is not 1, or in F31, F34, the insertion setting of the front sheet is not made, or in F37, the sheet feeding designation is conducted, the first sheet feeding is started (F38). That is, the sheet feeding means (any one of the sheet feeding means 51–54) corresponding to one recording sheet accommodating means in the designated recording sheet accommodating means 41–44 is driven, and the sheet feeding of the recording sheet R is started.

Next, it is judged whether the insertion of the sheet K (the partition sheet or the rear sheet)into the recording sheet R of the page number of the present sheet feeding counter (F39) is set. Then, when the insertion of the sheet K is not set, because it is not necessary to delay the next feeding recording sheet R, the insertion flag is set to 0 (F40). On the one hand, in F39, when the insertion of the sheet K is set, the insertion flag is set to 1 (F41) in order to delay the next feeding recording sheet R, and in the same manner as in F36, the existence of the sheet K to be inserted is judged (F42).

Herein, in F36 or F42, when the sheet K is not accommodated in the sheet accommodating means 75, the inhibition command is outputted (F43), and the sequence ends (F44). This inhibition command is outputted when there is no sheet K, and according to the inhibition command, the image formation is inhibited, and the feeding of the recording sheet R is inhibited. According to that, when the sheet K is used up, it is prevented that the recording material without the sheet K is made, and thereby, the conveyance failure of the recording sheet in the finishing apparatus FS can be prevented from being generated.

Incidentally, in the present embodiment, this inhibition is conducted on the recording sheet R which is scheduled to be stacked on the stacking section 72 after the sheet K which is detected not to exist, thereby, when the process is re-started after the sheet is replenished, the process may be started from the conveyance of the sheet, and the efficiency can be increased. However, the detection of the existence of the sheet K is conducted early, and the inhibition (the inhibition command when there is no sheet) may also be conducted on the recording sheet R which is scheduled to be stacked on the stacking section 72 after the sheet K supplied before the sheet K which is detected not to exist, and in this case, when it is detected that there is no sheet K in the sheet accommodating means 75, the useless conveyance of the recording sheet R can be omitted. Further, in the present embodiment, according to the inhibition command, both of the inhibition of the image formation and the inhibition of the feeding of the recording sheet R are conducted, and consumption of the energy is suppressed, however, at least one of them may be inhibited. Further, according to the inhibition command in F43, when the display means provided on the operation section AP of the image forming apparatus A and/or operation section AP of the finishing apparatus FS, conducts the alarm display, the user can exactly grasp the exhaustion of the sheets.

When the insertion flag is 0 in F40, or when it is judged that there is a sheet in F42, it is judged whether the recording sheet R supplied in F38 is the final page (F45), and when it is not the final page, the sheet feeding counter is added by (+1) (F46), the sequence returns to F26, and waits for the next sheet feeding timing. On the one hand, when it is the final page, it is judged whether it is the final volume (F47), and when it is not the final volume, 1 is set to the sheet feeding counter (F48), and the sequence returns to F26, and waits for the next sheet feeding timing. In F47, when it is judged that it is the final volume, because the image formation is completed, the sheet feeding control is completed (F49).

Figure 7:
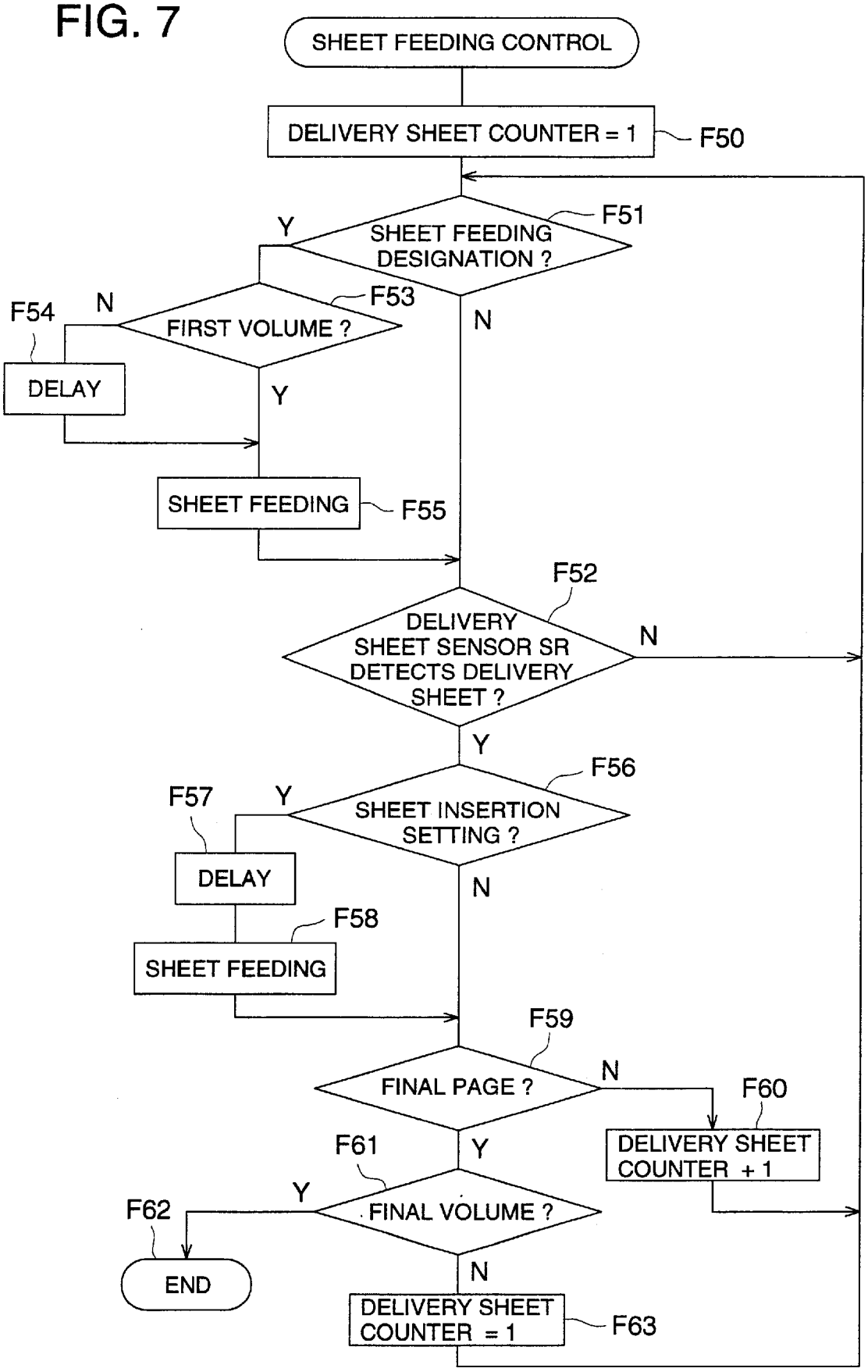
FIG. 7 is a flow chart showing the control of the second conveyance means.

Next, the sheet feeding control of the sheet K in the present embodiment, will be described according to FIG. 7, which is a flow chart showing the control of the second conveyance means (specifically, the sheet feeding roller 94, conveyance roller 95). In this control, the finishing control means FC is contacted with the image forming apparatus A, and further, corresponding to the conveyance condition (the detection signal of the delivery sheet sensor SR) of the recording sheet R, the sheet K accommodated in the sheet accommodating means 75 is sent out.

Initially, when the start of the job (image formation) is designated, the delivery sheet counter is set to 1 (F50). This delivery sheet counter is stored in the storing means FM, and is the page number of the recording sheet R which is image formed and delivered from the image forming apparatus.

Next, it is observed whether the sheet feeding command is outputted from the image forming apparatus A (F51), and whether the delivery sheet sensor SR detects the delivery sheet of the recording sheet (F52). The sheet feeding command in F51 is, as described above, the signal outputted from the image forming apparatus A (F37, in FIG. 6), when the front sheet K is attached before the first page of the first volume. That is, when the insertion of the front sheet K is set on the operation section of the finishing apparatus FS, or the operation section AP of the image forming apparatus A, the sheet feeding command is outputted from the image forming apparatus A, however, when it is not set, the command is not outputted. Then, when it is detected that the sheet feeding command is outputted from the image forming apparatus A (Y in F51), it is judged whether the command is for the first volume (F53), and when it is not for the first volume (when it is for the second and subsequent volume), a predetermined time period is delayed (F54). Because the delay in F54 is outputted almost simultaneously with the sheet feeding of the first page of the recording sheet R, it takes some time until the recording sheet R reaches the conveyance roller 92, therefore, the delay is prepared so that it is adjusted for the first page of the recording sheet R. Then, the finishing control means AC sends out the sheet K accommodated in the sheet accommodating means 75, and operates the second conveyance means so that the sheet K is conveyed to the stacking section 72, and conducts the sheet supplying (F55).

Independently of the output of the sheet feeding command, when the delivery sheet of the recording sheet R is detected by the delivery sheet sensor SR (Y in F52), it is judged whether the insertion of the sheet K (the partition sheet or the rear sheet) is set to the recording sheet R of the page number of the of the present delivery sheet counter (F56). When the insertion of the sheet K is set, after a predetermined time period is delayed (F57), the sheet K is supplied (F58). That is, in the above described sheet feeding control (refer to FIG. 6) of the recording sheet R, when the sheet K is inserted, because the next feeding recording sheet R is delayed, the interval between the recording sheet R detected by the delivery sheet sensor SR and the next conveying recording sheet R is more spread, and by using this spread interval, the sheet K is conveyed to the stacking section 72. Accordingly, the delay in F57 is the time which is set so that the sheet K conveyed by the sheet supplying roller 94 and the conveyance roller 95, is conveyed by the conveyance roller 92, after the recording sheet R detected by the delivery sheet sensor SR in F52, passes the conveyance roller 92, and until the next recording sheet R reaches the conveyance roller 92. In other words, a time period which is set so that the sheet K is not overlapped with the recording sheet R detected in F52 and the next recording sheet R, is delayed in F57, and the sheet supplying of the sheet K is started (F58).

Next, it is judged whether the recording sheet R passed the delivery sheet sensor SR is the final page (F59), and when it is not the final page, the delivery sheet counter is added by (+1) (F60), and the sequence returns to F51, and when it is the final page, it is judged whether the recording sheet R is the final volume (F61). Then, when it is judged that the recording sheet R is the final volume, the sheet feeding control of the sheet K is completed (F629. On the one hand, in F61, when it is not the final volume, the delivery sheet counter is set by 1 (F63), and the sequence returns to F51.

As described above, in the present embodiment, because the finishing control means AC controls the second conveyance means according to the insertion position of the sheet inputted from the input means (refer to FIG. 3 and FIG. 4) provided on the operation section AP of the finishing apparatus FS, or according to the insertion position of the sheet which is inputted by the input means (refer to FIG. 5) provided on the operation section AP of the image forming apparatus A and transmitted through communication means AI, and FI, thereby, when the sheet is inserted, the insertion position can be arbitrarily set in the finishing apparatus, and not only the operability is increased, but the operation can also be assuredly conducted. Specifically, in the present embodiment, it is set that the interval of the recording sheet R fed in the image forming apparatus A is larger than in the case where the sheet K is not inserted, and because, by using this larger interval between the recording sheets, the sheet R is conveyed (inserted), the conveyance of the recording sheet R and the sheet K in the finishing apparatus FS is stably conducted, and the conveyance failure of the recording sheet R and the sheet K and jamming in the finishing apparatus FS can be prevented.

Further, in the present embodiment,.when it is detected by the sheet sensor SK that there is no sheet in the sheet accommodating means 75, it is transmitted to the image forming apparatus A through the communication means FI and AI, and in the image forming apparatus A, when this signal is received, the image formation is inhibited, and the feeding of the recording sheet R is inhibited. In other words, when it is detected by the sheet sensor SK that there is a sheet K, after the sheet K sent out by the sheet feeding roller 94, the sheet feeding to the recording sheet R which is scheduled to be stacked on the stacking section 72 and the image formation are started. Accordingly, it can be prevented that the recording material having no sheet K is made.

Figure 8:
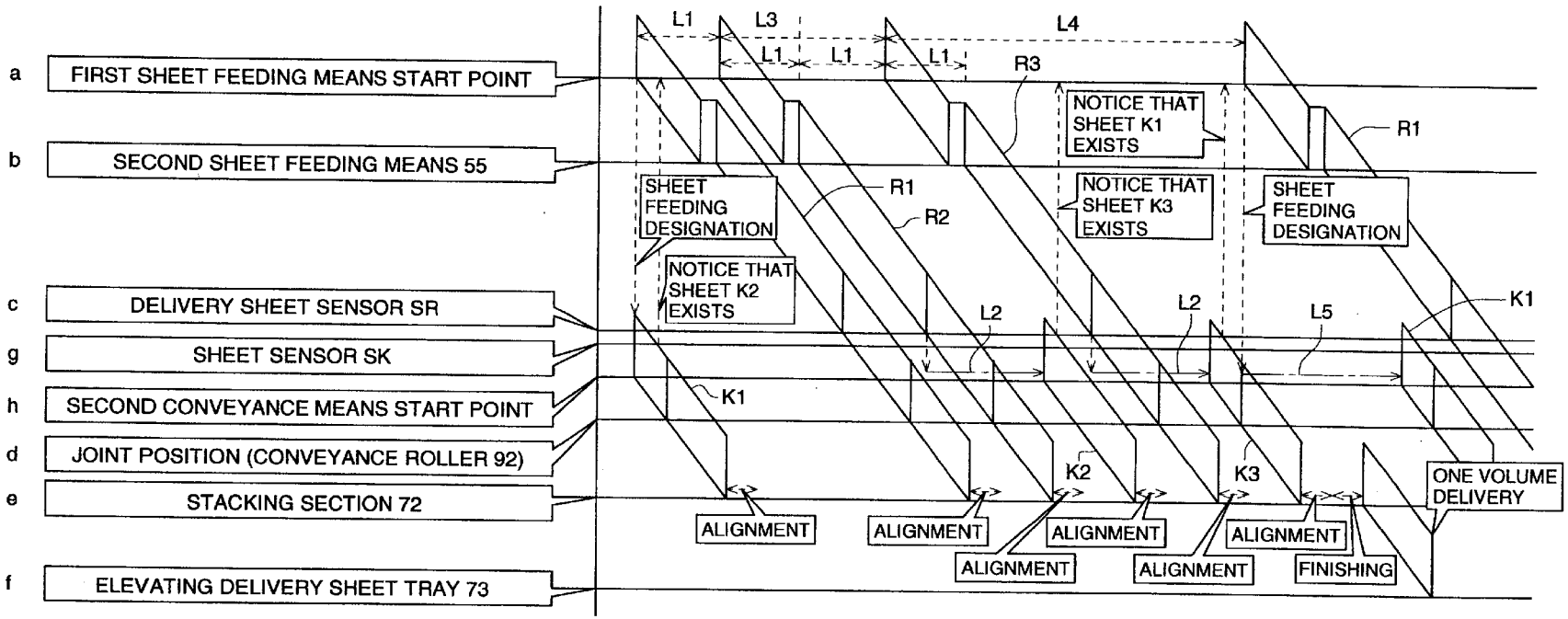
FIG. 8 is a time chart of the image forming system, in which an attention is paid to the conveyance of the recording sheet and sheet.

Next, centering around the conveyance of the recording sheet R and the sheet K in the image forming system of the present embodiment, its operation will be described. FIG. 8 is a time chart of the image forming system in which the primary attention is paid on the conveyance of the recording sheet R and the sheet K, and shows the case in which the front sheet K1 and the rear sheet K3 are inserted into 3 pages of recording sheet R1–R3, and a partition sheet K2 is inserted between the second page of the recording sheet R2 and the third page recording sheet R3, and a plurality of this volumes are formed, and further, after these are staple processed by the staple means 82, these are delivered onto the elevating delivery sheet tray 73. Incidentally, FIG. 8 shows a case in which the recording sheets R1–R3 are accommodated in the recording sheet accommodating means 41 and fed by the first sheet feeding means 51.

In FIG. 8, the horizontal axis is a time axis, and the vertical axis shows a position on the conveyance path of the recording sheet R and the sheet K, and the upper side shows the upstream side and the lower side shows the downstream side respectively. In details, the horizontal axis a in FIG. 8 is a position of the starting point (a roller positioned at the most upstream side) of the first sheet feeding means 51, and the horizontal axis b is a position of the second sheet feeding means 55, the horizontal axis c is a position of the delivery sheet sensor SR, the horizontal axis d is a joint position of the recording sheet R and the sheet K, and the position of the conveyance roller 92, the horizontal axis e is a position of the stacking section 72, the horizontal axis f is a position of the elevating delivery sheet tray 73, the horizontal axis g is a position of the sheet sensor SK, and the horizontal axis h expresses the starting point (the roller positioned at the most upstream side, in the present embodiment, the sheet feeding roller 94) of the second conveyance means. Incidentally, in the present embodiment, a portion of the conveyance path of the recording sheet R is not common to the conveyance path of the sheet K, however, this portion is shown in the same manner as each other in FIG. 8.

Figure 6:
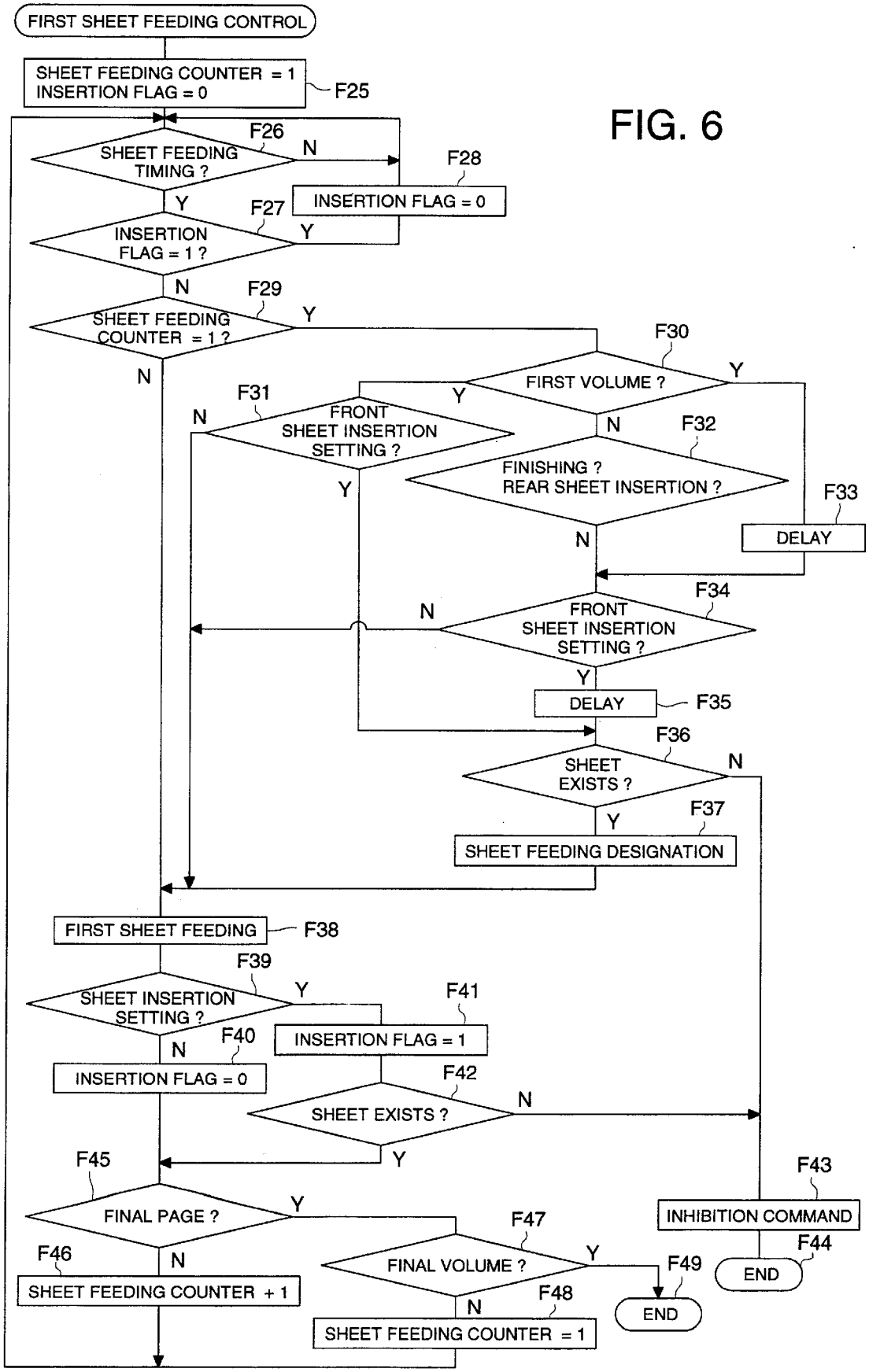
FIG. 6 is a flow chart showing the control of the first sheet feeding means.

Initially, the job (image formation) is started, the first page recording sheet R1 is fed from the recording sheet accommodating means 41 in which the recording sheet R1 is accommodated, by the fist sheet feeding means 51 (F38 in FIG. 6). Simultaneously with this, because the insertion of the front sheet K1 is set, the image forming apparatus A outputs the sheet feeding command to the finishing apparatus FS (F37 in FIG. 6). The finishing apparatus FS receives this sheet feeding command and sends out the sheet K (the front sheet K1) accommodated in the sheet accommodating means 75, by the sheet supplying roller 94, and conveys it to the stacking section 72 by the conveyance rollers 95, 92, and 93. Herein, on the way in which the front sheet K1 is sent out by the sheet supplying roller 94, when the trailing edge of the front sheet K1 passed through the sheet sensor SK, the existence of the sheet K (partition sheet K2) subsequent to the front sheet K1 is confirmed, and the existence of the partition sheet K2 in the sheet accommodating means 75 is outputted to the image forming apparatus A. The front sheet K1 conveyed to the stacking section 72 is aligned in the direction perpendicular to the drawing, by the regulation plate 721.

On the one hand, the leading edge of the recording sheet R1 fed by the fist sheet feeding means 51 is stopped once by the second sheet feeding means 55 (loop is formed and the curl is corrected at need), and the recording sheet R1 is in timed relationship with the toner image on the photoreceptor drum formed by the image forming means 3, and re-feeding of the sheet is started. Then, the recording sheet R1 is, as described above, read out by the image reading means 1, separately, and the toner image on the photoreceptor drum formed by the image forming section 32 is transferred onto the recording sheet R1, and fixed by the fixing section 33, and after that, the recording sheet R1 is delivered outside the image forming apparatus A.

The delivered recording sheet R1 is sent to the finishing apparatus FS, and detected by the delivery sheet sensor SR, and, by the conveyance rollers 91–93 which are the first conveyance means, conveyed onto the stacking section 72 (on the front sheet K1) on which the front sheet K1 is stacked. After that, in the same manner as the above described front sheet K1, it is aligned in the direction perpendicular to the drawing by the regulation plate 721.

After the first page recording sheet R1 is fed, the first sheet feeding means 51 feeds the second page recording sheet R2 after a predetermined time L1 after the sheet feeding of the recording sheet R1, by the sheet feeding timing generated at every interval in F26 in FIG. 6. The fed recording sheet R2 is, in the same manner as the above described recording sheet R1, stopped once by the second sheet feeding means 55, and after that, conveyed again, and the transferring of the toner image and fixing are conducted, and by the conveyance rollers 91–93, the recording sheet R2 is conveyed onto the stacking section 72 (on the recording sheet R1) on which the recording sheet R1 is stacked, and aligned by the regulation plate 721.

Incidentally, in this case, because it is set that the partition sheet K2 is inserted between the second page recording sheet R2 and the third page recording sheet R3, when the second page recording sheet R2 is detected by the delivery sheet sensor SR (F52 in FIG. 7), after a predetermined time (L2) is delayed, the finishing apparatus FS sends out the partition sheet K2 accommodated in the sheet accommodating means 75, by the sheet supplying roller 94, and by the conveyance rollers 95, 92, and 93, it is conveyed onto the stacking section 72 (onto the recording sheet R2) on which the front sheet K1, recording sheets R1, and R2 are stacked. Incidentally, the predetermined time L2 is set in such a manner that, as will be described later, the partition sheet K2 is inserted between the recording sheet R2 and the recording sheet R3 which are conveyed so that the interval is increased. Herein, at the time point when the trailing edge of the partition sheet K2 passes through the sheet sensor SK, the existence of the sheet K (the rear sheet K) succeeding to the partition sheet K2 is confirmed, and it is outputted to the image forming apparatus A that there is a rear sheet K3 in the sheet accommodating means 75. The partition sheet K2 conveyed to the stacking section 72 is aligned by the regulation plate 721.

On the one hand, the first sheet feeding means 51 feeds the third page recording sheet R3 after the second page recording sheet R2 is fed, however, because the partition sheet K2 is inserted between the recording sheet R2 and the recording sheet R3, the sheet feeding of the third page recording sheet R3 is delayed. That is, when the sheet is not inserted, the third page recording sheet R3 is fed after a predetermined time L1 after the second page recording sheet is fed, however, in the present embodiment, in order to insert the sheet K2, further the predetermined time L1, in other words, after a predetermined time L3 (L1×2) after the feeding of the recording sheet K2, the feeding of the third page recording sheet R3 is started. Then, after the third page recording sheet R3 which is fed by being delayed, is stopped once by the second sheet feeding means 55, in the same manner as described above, it is conveyed again, and transferring, and fixing are conducted thereon, and the recording sheet R3 is conveyed onto the stacking section 72 (onto the partition sheet K2) on which the front sheet K1, recording sheets R1 and R2, and the partition sheet K2 are stacked, by the conveyance rollers 91–93, and aligned by the regulation plate 721.

Incidentally, in this case, because it is set that the rear sheet K3 is inserted after the third page recording sheet R3, which is the final page, when the third page recording sheet R3 is detected by the delivery sheet sensor SR (F52 in FIG. 7), after the predetermined time (L2) is delayed (F57 in FIG. 7), the finishing apparatus FS sends out the rear sheet K3 accommodated in the sheet accommodating means 75 by the sheet supplying roller 94, and conveys it onto the staking section 72 on which the front sheet K1, recording sheets R1, R2, partition sheet K2 and recording sheet R3 are stacked, by the conveyance rollers 95, 92, and 93. Herein, at the time point when the trailing edge of the rear sheet K3 passes through the sheet sensor SK, the existence of the sheet K (the front sheet K for the next volume) succeeding to the rear sheet K3 is confirmed, and it is outputted to the image forming apparatus A that there is a front sheet K1 in the sheet accommodating means 75. The rear sheet K3 conveyed to the stacking section 72 is aligned by the regulation plate 721.

When the front sheet K1, recording sheets R1, R2, partition sheet K2, recording sheet R3, and rear sheet K3 are stacked on the stacking section 72, and aligned, the staple processing (finishing) by the staple means 82 is conducted, and after that, the processed sheets are delivered onto the elevating delivery sheet tray 73, and the first volume is completed.

Incidentally, after the third page recording sheet R3 of the first volume is fed by the first sheet feeding means 51, when the setting of the rear sheet K3, finishing, and the front sheet K1 of the second volume are not made, the sheet feeding of the first page R1 of the second volume is started after a predetermined time L1 after the sheet feeding of the recording sheet R3, however, in the present embodiment, because these are set, the delay time L4 until the sheet feeding of the first page recording sheet R1 of the second volume is started, is a longer delay time between a predetermined time L4' in which the delay for the rear sheet K3 insertion (in FIG. 6, the delay using an insertion flag), the delay for the finishing (F33 in FIG. 6), and the delay for the front sheet K1 insertion (F35 in FIG. 6) are summed up, and the delay time L4" until it is noticed that there is a sheet K1 (in the present embodiment, because the sheet feeding of the recording sheet R1 can not be started until it is confirmed that there is a sheet K1). In the present embodiment, because L4" is longer, the sheet feeding of the first page recording sheet R1 of the second volume by the first sheet feeding means 51 is started after the predetermined time L4 (L4") after the sheet feeding of the recording sheet R3. Incidentally, as in the present embodiment, when L4" is longer than L4", in order to further increase the productivity, a mode in which the pre-feeding of the sheet K is conducted, will be described in the embodiment 3.

Then, simultaneously with this, the sheet feeding command of the front sheet K1 is outputted to the finishing apparatus FS (F37 in FIG. 6), and the sheet K (the front sheet K1) accommodated in the sheet accommodating means 75 is conveyed onto the stacking section 72 by the conveyance rollers 95, 92 and 93. The following description is the same as in the case of the above described first volume, therefore, the explanation will be omitted.

As described above, in the present embodiment, when the sheet K is inserted, by increasing the conveyance interval of the recording sheet R, the finishing can be conducted without increasing the conveyance speed of the recording sheet R in the finishing apparatus FS to the conveyance speed of the recording sheet R in the image forming apparatus, thereby, the recording sheet R can be stably conveyed. Further, when the sheet K is inserted between the recording sheets R without increasing the interval of the recording sheets R, in order to avoid the interference of the recording sheet R with the sheet K, it is necessary that the conveyance speed of the recording sheet R in the finishing apparatus FS is changed to greater than twice, and due to such the change of the conveyance speed of the recording sheet R, the conveyance becomes unstable, thereby, the conveyance failure and jamming easily occur, however, the present embodiment can prevent it.

Incidentally, in the present embodiment, the control to increase the interval between the recording sheets R is simplified in the control and preferable when the setting of the delay time of the recording sheet R is made such that the integer times of the interval when the sheet K is not inserted, that is, the sheet feeding timing generated every predetermined time interval L1 is skipped by one time or a plurality of times. Further, in the description in FIG. 8, the case where there is a sheet K in the sheet accommodating means 75, is described, however, when it is detected by the sheet sensor SK that there is no sheet K, as described in FIG. 6, the image formation is inhibited, and the feeding of the recording sheet R is inhibited.

Figure 9:
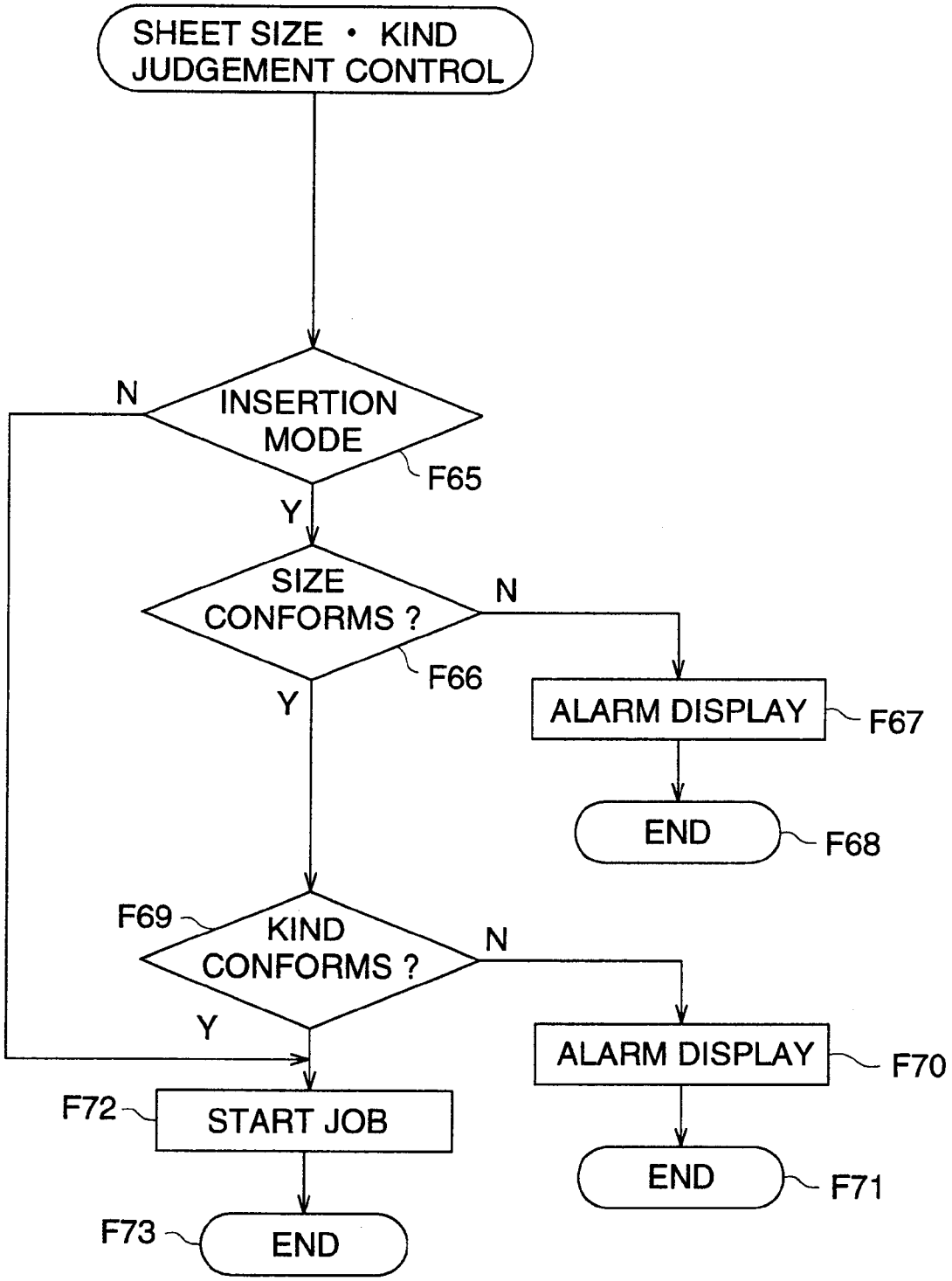
FIG. 9 is a flow chart showing the control relating to the size and the kind.

Incidentally, in the present embodiment, when a plurality of sheet sensors SK which are detecting means for detecting the existence of the sheet accommodated in the sheet accommodating means 75 of the finishing apparatus FS, are provided, the size of the sheet K can be detected. Therefore, the size of the sheet K accommodated in the sheet accommodating means 75 is detected, and it is judged whether the size of the sheet K is conformable to the size of the recording sheet R on which the image is formed, and the control according to the judgement can be conducted. Further, not only the conformity of the sheet K size to the recording sheet R size (specifically, conformity to the size), but it is also judged in addition to the size whether the kinds of the sheet R (for example, the thick sheet of paper, thin sheet of paper, tabbed sheet with a tab, colored sheet) conform to those of the recording sheet R, and the control according to the judgement, can be conducted. FIG. 9 is a flow chart showing the control relating to this size and the kind, and is a flow conducted before the start of the job (image formation).

When the start of the job (image formation) is inputted from the operation section AP, the judgement control of the sheet size and the kind shown in FIG. 9 is conducted. Initially, it is judged whether the sheet K is the insertion mode (F65), when it is not the insertion mode, the job is started (F72), and the judgement control of the sheet size and the kind, is completed (F66). When the size does not conform, the alarm display that the size does not conform, is conducted (F67), and the judgement control of the sheet size and the kind is completed (F68).

Herein, in the present embodiment, the conformity of the size in F66 means that the size of the sheet accommodated in the sheet accommodating means 75 is in the conformity to the size of the recording sheet R on which the image is formed, and in more detail, the sheet K size conforms to the recording sheet R size. The size of the sheet K accommodated in the sheet accommodating means 75 can be detected, as described above, by providing a plurality sensors SK, and by functioning these sensors as the sheet size detection means. Further, the size of the recording sheet R is determined by the size of the recording sheet R accommodated in the recording sheet accommodating means 41–44 provided corresponding to the first sheet feeding means 51–54 driven by the image forming control means AC (previously, it may set by the operator, or may be automatically detected). Incidentally, when the operator designates the size of the recording sheet R from the operation section AP, the specified size may be used. Then, it is judged in F66 whether the sheet size detected by the plurality of sheet sensors SK conforms to the recording sheet size on which the image is formed.

Incidentally, the sheet size detection means is not provided, and the input means provided on the operation section AP or the operation section FP is functioned as the sheet size registration means to register the size of the sheet K accommodated in the sheet accommodating means 75, and by storing the sheet size inputted from the input means in the storing means FM, AM, the size of the sheet K may be registered. Further, in the present embodiment, the conformity of the size is made to be conformable, however, a button to specify the size of the sheet K is provided on the input means of the operation sections AP and FP, and it is functioned as a specifying means, and a case in which the specified size conforms to the size detected by the size detection means, or the size registered by the registration means, may also be made to be conformable.

In F66, when the size conforms to each other, next, it is judged whether the kind conforms to each other (F69). When the kind is not conformable, the alarm display that the kinds is not conformable, is conducted (F70), and the size and kind judgement control ends (F71).

Herein, in the present embodiment, the conformity of the kind in F69 means the kind of the sheet K accommodated in the sheet accommodating means 75 conforms to the kind of the sheet specified when the image is formed, or not. As this kind, for example, there is a thick sheet of paper, thin sheet of paper, tabbed sheet with a tab, and colored sheet. Further, the kind of the sheet K accommodated in the sheet accommodating means 75 is may be directly detected by providing the detection means for detecting the kind of the sheet K, or the input means provided on the operation section AP or the operation section FP is functioned as the sheet kind registration means for previously registering the kind of the sheet K accommodated in the sheet accommodating means 75, and the kind of the sheet K may also be registered by storing the kind of the sheet K inputted by the input means in the storing means FM or AM. Then, the kind of the sheet specified when the image is formed, may be specified by using the input means (it is functioned as the sheet kind specifying means) provided on the operation section AP or the operation section FP, when the insertion mode is set.

As described above, when the sheet size does not conform to the recording sheet size, when the sheet size does not conform to the specified sheet size, or when the kind of the sheet does not conform to the specified kind of the sheet, the start of the job in F72 is not conducted, in other words, both of the image formation and the sheet feeding of the recording sheet R are inhibited (at least one of them may be allowed, but both of them are preferable). Accordingly, it can be prevented that the sheet which does not conform to the size of the recording sheet is attached to the recording sheet, or that the sheet which does not conform to the size or the kind of the specified sheet is attached to the recording sheet.

(2) Embodiment 2

Next, Embodiment 2 will be described. The above described Embodiment 1 is structured such that, in order to insert the sheet K, the conveyance timing of the recording sheet R is controlled by the first sheet feeding means 51 54 (when the sheet K is inserted, the interval is more spread than that in the case where the sheet K is not inserted), however, in the present embodiment, it is controlled by the second sheet feeding means 55, and the structures are almost the same as those in the Embodiment 1 (the numerals and signs are the same), and the explanation will be neglected, and the different points will be described below.

In the conveyance of the recording sheet R by the first sheet feeding means 51–54, the conveyance is started simultaneously when the previously fed recording sheet R is conveyed by the second sheet feeding means 55. Incidentally, in the conveyance of the recording sheet R by the first sheet feeding means 52 and 53 in which the distance to the second sheet feeding means 55 is long, the recording sheet R may be stood by between the second sheet feeding means 55 and the first sheet feeding means 52 and 53, and in this case, the sheet feeding of the recording sheet by the first sheet feeding means 52 and 53 may be started simultaneously when the standing-by recording sheet (previously fed recording sheet) R is conveyed again.

The conveyance of the recording sheet R by the second sheet feeding means is conducted such that the recording sheet R is conveyed by the first sheet feeding means 51–54, and once, the stopped recording sheet R is conveyed in timed relationship with the toner image formed by the image forming section 32 at every predetermined timing. At this time, in the same manner as the first sheet feeding means in the above described embodiment 1, when the insertion of the sheet K is set, after a predetermined time is delayed so that the interval to the recording sheet R previously conveyed by the second sheet feeding means 55 is increased, the conveyance is started again. Incidentally, when the front sheet K is set, the time point of the start of re-conveyance by this second sheet feeding means 55, is the time point of the start of the conveyance of the sheet K by the sheet supplying roller 94.

Figure 10:
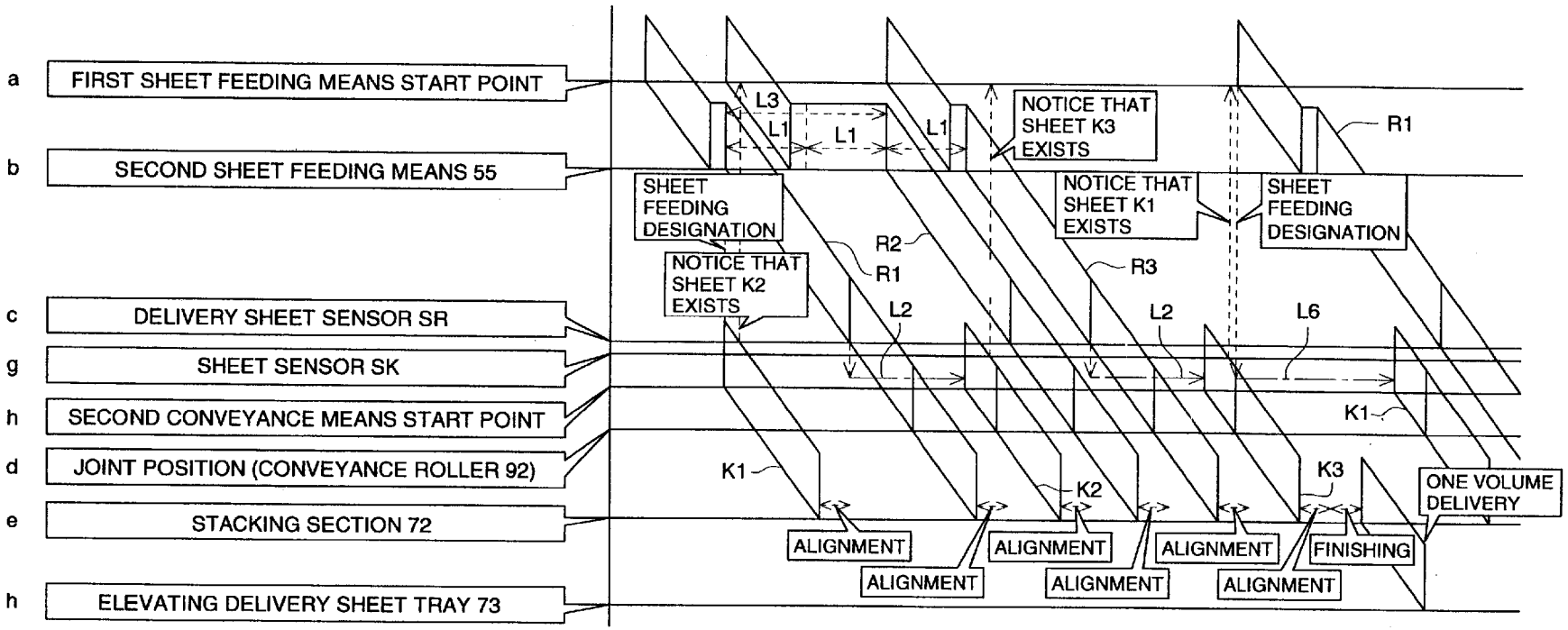
FIG. 10 is a time chart of the image forming system in Embodiment 2, in which an attention is paid to the conveyance of the recording sheet and sheet.

Next, centering around the conveyance of the recording sheet R and the sheet K in the image forming system in the present embodiment, its operation will be described. FIG. 10 is a time chart of the image forming system in which an attention is paid to the conveyance of the recording sheet R and the sheet K, and it is a case in which the front sheet K1 and the rear sheet K3 are inserted into the 3 pages of recording sheets R1–R3, and the partition sheet K2 is inserted between the first page recording sheet R1 and the second page recording sheet R2, and a plurality of volumes of these sheets are made, and further, a case in which, after these sheets are staple processed by the staple means 82, these sheets are delivered onto the elevating delivery sheet tray 73. Further, it is a case in which the recording sheets R1–R3 are accommodated in the recording sheet accommodating means 41, and are fed by the first sheet feeding means 51. Incidentally, the vertical axis and the horizontal axis in FIG. 10 are the same as in the above described FIG. 8.

Initially, when the job (image formation) is started, the first page recording sheet R1 is fed from the recording sheet accommodating means 41 in which the sheet R1 is accommodated, by the first sheet feeding means 51, and is stopped once by the second sheet feeding means 55. Then, the re-feeding is started in timed relationship with the toner image on the photoreceptor drum formed by the image forming means 3.

Simultaneously with this, because the insertion of the front sheet K1 is set, the image forming apparatus A outputs the sheet feeding command to the finishing apparatus FS. The finishing apparatus FS receives this sheet feeding command, and conveys the sheet K (front sheet K1) accommodated in the sheet accommodating means 75 to the stacking section 72, by the conveyance roller 95, 92, and 93. Herein, at the time point when the trailing edge of the front sheet K1 passes through the sheet sensor SK, the existence of the sheet K (partition sheet K2) succeeding to the front sheet K1 is confirmed, and it is outputted to the image forming apparatus A that there is a partition sheet K2 in the sheet accommodating means 75. The front sheet K1 conveyed to the stacking section 72 is aligned by the regulation plate 721 in the direction perpendicular to the drawing.

The re-conveyed recording sheet R1 is, separately, read by the image reading means 1, and the toner image on the photoreceptor drum formed by the image forming section 32, is transferred onto the recording sheet R1, and after it is fixed in the fixing section 33, it is delivered outside the image forming apparatus A.

The delivered recording sheet R1 is sent into the finishing apparatus FS, and detected by the delivery sheet sensor SR, and is conveyed onto the stacking section 72 (onto the front sheet K1)by the conveyance rollers 91–93. After that, the recording sheet R1 is aligned by the regulation plate 721 in the direction perpendicular to the drawing.

Incidentally, in this case, because it is set that the partition sheet K2 is inserted between the recording sheet R1 and the recording sheet R2, when the recording sheet R1 is detected by the delivery sheet sensor SR, after a predetermined time (L2) is delayed, the finishing apparatus FS conveys the partition sheet K2 to the stacking section 72 (onto the recording sheet R1) on which the front sheet K1, and recording sheet R1 are stacked, by the sheet supplying roller 94, conveyance rollers 95, 92, and 93. Incidentally, the predetermined time L2 is set so that the partition sheet K2 is inserted between the recording sheet R1 and the recording sheet R2 conveyed by the second sheet feeding means 55 so that the interval becomes large. Herein, at the time point when the trailing edge of the partition sheet K2 passes through the sheet sensor SK, the existence of the sheet K (rear sheet K3) succeeding to the partition sheet K2 is confirmed, and it is outputted to the image forming apparatus A that there is a rear sheet K3 in the sheet accommodating means 75. The partition sheet K2 conveyed onto the stacking section 72 is aligned by the regulation plate 721.

After the recording sheet R1 is fed, the first sheet feeding means 51 starts the sheet feeding of the second page recording sheet R2, simultaneously with the re-conveyance of the first page recording sheet R1 by the second sheet feeding means 55. The fed recording sheet R2 is stopped once by the second sheet feeding means 55. Herein, because the insertion of the sheet K2 between the first page recording sheet R1 and the second page recording sheet R2 is set, after the refeeding of the recording sheet R1, the second sheet feeding means 55 stops the recording sheet R2 once, and conveys it again, and in order to insert the partition sheet K2 between the recording sheet R1 and the recording sheet R2, it delays the re-conveyance of the recording sheet R2. That is, when the sheet is not inserted, after a predetermined time L1 after the re-conveyance of the recording sheet R1, the recording sheet R2 is conveyed again, however, in order to insert the sheet K2, in the present embodiment, further a predetermined time L1, in other words, after a predetermined time L3 (L1×L2) after the re-conveyance of the recording sheet R1, the re-conveyance of the recording sheet R2 is started. The re-conveyed recording sheet R2 is subjected to the transferring of the toner image, and fixing, and conveyed to the stacking section 72 (onto the partition sheet K2) on which the front sheet K1, recording sheet R1 and partition sheet K2 are stacked, by the conveyance rollers 91–93, and aligned by the regulation plate 721.

On the one hand, after the recording sheet R2 is fed, the first sheet feeding means 51 feeds the recording sheet R3 simultaneously when the second conveyance means 55 conveys again the recording sheet R2. The fed recording sheet R3 is stopped once by the second sheet feeding means 55. Then, after a predetermined time L1 after the re-conveyance of the recording sheet R2, the second conveyance means 55 is in timed relationship with the toner image, and conveys again the recording sheet R3, and the transferring of the toner image and fixing are conducted on the recording sheet R3, and the recording sheet R3 is conveyed onto the stacking section 72 (onto the recording sheet R2) on which the front sheet K1, recording sheets R1 and R2, partition sheet K2 are stacked, by the conveyance rollers 91–93, and is aligned by the regulation plate 721.

Incidentally, in this case, because it is set that the rear sheet K3 is inserted after the recording sheet R3 which is the final page, when the recording sheet R3 is detected by the delivery sheet sensor SR, after a predetermined time (L2) is delayed, the finishing apparatus FS conveys the rear sheet K3 accommodated in the sheet accommodating means 75 onto the stacking section 72 (onto the recording sheet R3) on which the front sheet K1, recording sheet R1, partition sheet K2, recording sheets R2 and R3 are stacked. Herein, at the time point when the trailing edge of the rear sheet K3 passes through the sheet sensor SK, the existence of the sheet K succeeding to the rear sheet K3 (the front sheet K1 for the next volume) is confirmed, and it is outputted to the image forming apparatus A that there is a front sheet K1 in the sheet accommodating means 75. The rear sheet K2 conveyed to the stacking section 72 is aligned by the regulation plate 721.

When the front sheet K1, recording sheet R1, partition sheet K2, recording sheets R2 and R3, and the rear sheet K3 are stacked on the stacking section 72, and aligned, the staple processing (finishing) by the staple means 82 is conducted, and after that, the sheets are delivered onto the elevating delivery sheet tray 73, and the first volume is completed.

Incidentally, simultaneously when the recording sheet R3 of the first volume is re-conveyed by the second sheet feeding means 55, the sheet feeding of the recording sheet R1 of the second volume is started by the first sheet feeding means 51, and the recording sheet R1 is stopped by the second sheet feeding means 55. After this stoppage, after a predetermined time in which a delay for the rear sheet K3 insertion, a delay for finishing, and a delay for the front sheet K1 insertion are summed up, the re-conveyance of the first page recording sheet R1 of the second volume by the second sheet feeding means 55 is started. Then, simultaneous with this, the sheet feeding command of the front sheet K1 is outputted to the finishing apparatus FS. The process following that is the same as in the case of the above described first volume, therefore, the description will be neglected.

When such the control of the sheet feeding interval is conducted, in the same manner as in the above described embodiment 1, without increasing the conveyance speed of the recording sheet R in the finishing apparatus FS, the finishing can be conducted, thereby, the stable conveyance of the recording sheet and the sheet in the finishing apparatus FS can be secured.

(3) Embodiment 3

Next, Embodiment 3 will be described. In the above described embodiment 1 and 2, when the sheet K accommodated in the sheet accommodating means 75 is conveyed to the stacking section 72 by the second conveyance means 94, 95, 92 and 93, the sheet K is conveyed without stopping only once, however, in the present embodiment, the sheet K is previously fed (conveyed) (hereinafter, called pre-feeding), and the sheet K is stopped once, and conveyed again to the stacking section 72, and the structures are the same as those in the embodiments 1 and 2 (numerals and signs are the same), therefore, the explanation is neglected, and the different points will be described below.

In the present embodiment, the sheet supplying roller 94 is functioned as the sheet supplying means for sending the sheet K accommodated in the sheet accommodating means 75 one by one sheet, and the conveyance roller 95 is functioned as re-conveyance means for stopping the sheet K sent out by the sheet supplying roller 94 once, and after that, conveying it again.

Figure 12:
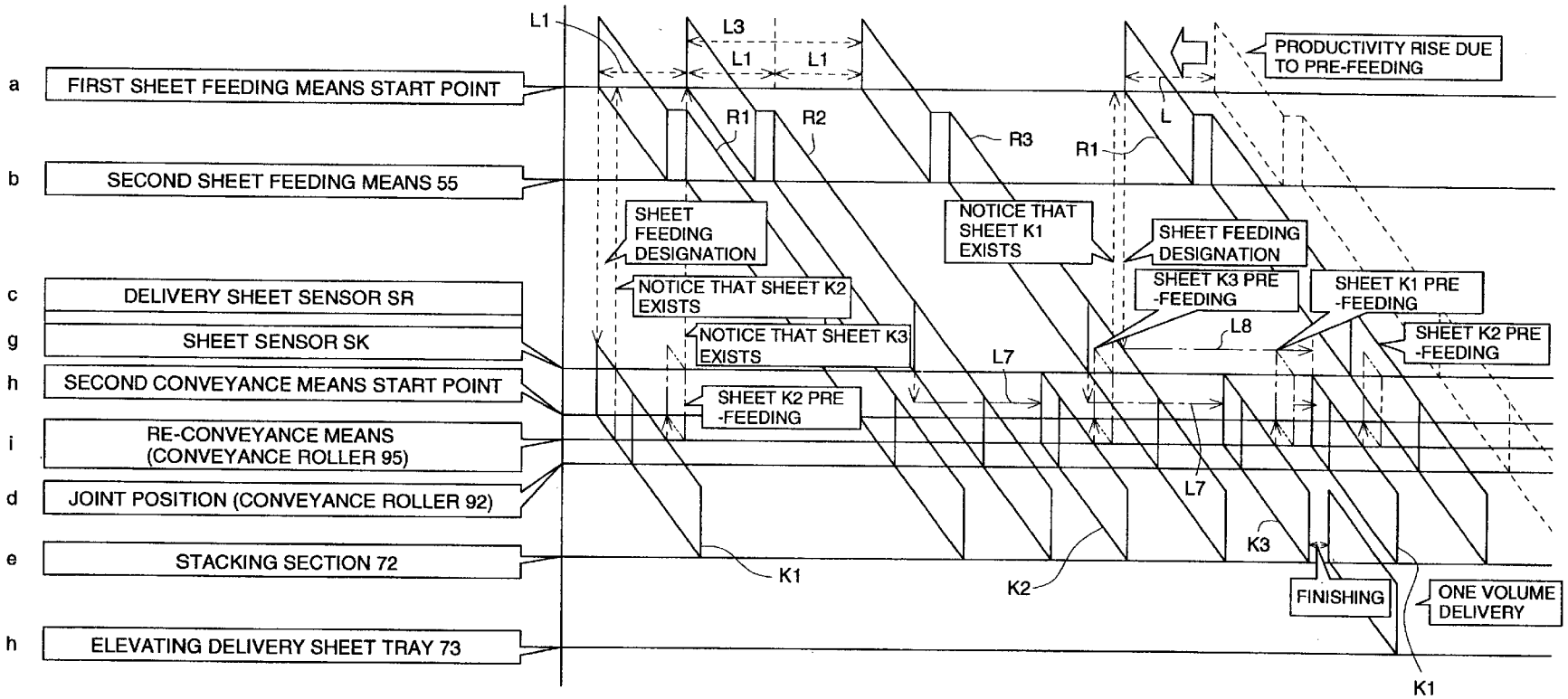
FIG. 12 is a time chart of the image forming system in Embodiment 3, in which an attention is paid to the conveyance of the recording sheet and sheet.

Further, when the sheet K is sent out by the sheet supplying roller 94, and does not reach the detection means, not shown, provided before the conveyance roller 95 within a predetermined time, the sheet supplying roller 94 is stopped once, and when, after a predetermined time, the sheet K is sent out again by the sheet supplying roller 94, so called double-try operation is conducted (because the pre-feeding, when the insertion setting of the sheet is not continuously specified, for example, as the pre-feeding of the sheet K in FIG. 12, because there is a sufficient time), the no-feeding of the sheet K is prevented (because the chance of sending out becomes twice, and the probability of no-feeding becomes ½ in a simple calculation), and the sheet feeding performance can also be increased.

Further, the temporarily stoppage of the sheet k is in a condition that the leading edge of the sheet K is just nipped by the conveyance roller 95 (a condition in which a loop is formed and the curl is corrected at need) after a predetermined time after the leading edge of the sheet K reaches the detection means, not shown, provided before the conveyance roller 95 (upstream side in the sheet conveyance direction). Generally, in the sending-out of the sheet K by the sheet supplying roller 94, and the re-conveyance of the sheet nipped by the conveyance roller 95, it is empirically found that the sheet feeding performance of the latter is superior, and when it is combined with the double-try operation, the higher sheet feeding performance can be secured.

Then, the detection means, not shown, detects that the sheet K re-conveyed by the conveyance roller 95 passes through the conveyance roller 95, and according to this result, the sheet supplying roller 94 is driven, and the pre-feeding of the next sheet K is conducted to the conveyance roller 95.

Specifically, according to FIG. 11, which is a flow chart showing the control of the second conveyance means (specifically, the sheet supplying roller 94 and the conveyance roller 95) for conveying the sheet K to the stacking section 72, the control will be described below. Incidentally, in FIG. 11, the same numerals and signs are denoted to the same steps as in FIG. 7 (sometimes the explanation will be omitted).

Initially, when the start of the job (image formation) is designated, the delivery sheet counter is set to 1 (F50), and it is observed whether the sheet feeding command is outputted from the image forming apparatus A (F51), and whether the delivery sheet sensor SR detects the delivery sheet of the recording sheet (F52). Then, when it is detected that the sheet feeding command is outputted from the image forming apparatus A (Y in F51), it is judged whether it is the fist volume (F53), and when it is the first volume, the feeding and conveyance of the sheet K (front sheet K1) accommodated in the sheet accommodating means 75 by the sheet supplying roller 94 and the conveyance roller 95 are started (F75), and the sheet K1 is conveyed to the stacking section 72 through the conveyance rollers 92 and 93.

In F53, when it is not the first volume (second and the subsequent volume), a predetermined time is delayed (F76), the re-conveyance of the sheet K which is pre-conveyed in F83, which will be described later, by the conveyance roller 95 is started (F77). In this delay in F76, the delay time is shorter by the time period in which the sheet K is pre-conveyed. Then, when the sheet K is conveyed by the conveyance roller 95 in F75 or F77, it is judged whether the insertion of the next sheet K succeeding to the conveyed sheet K is set (F78), and when it is not set, the sequence moves to F52, and when it is set, the pre-feeding of the next sheet K by the sheet supplying roller 94 is conducted. Herein, in the present embodiment, the detection means, not shown, detects that the sheet K re-conveyed by the conveyance roller 95 passes through thee conveyance roller 95, and according to this detection result, the sheet supplying roller 94 is driven, and the next sheet K is pre-fed to the conveyance roller 95.

When the delivery sheet of the recording sheet R is detected by the delivery sheet sensor SR in F52, it is judged whether the insertion of the sheet K (partition sheet or rear sheet) into the recording sheet R whose page number corresponds to the present page number of the delivery sheet counter, is set (F56), and when it is set, after a predetermined time delay (F80), the re-conveyance of the sheet K which is pre-fed in F79 or F83, is started by the conveyance roller 95 (F81). Incidentally, in the delay in F80, the delay time is shorter than the delay in F57 in FIG. 7, by a time period in which it is pre-fed.

That is, in the same manner as in the sheet feeding control of the recording sheet R, when the sheet K is inserted, the recording sheet R which is fed next, is delayed (it is delayed in the embodiment 1, by the first sheet feeding means, in the second embodiment, by the second embodiment), therefore, the interval between the recording sheet R detected by the delivery sheet sensor SR and the next conveyed recording sheet R is increased, and by using the increased interval, the sheet K is conveyed to the stacking section 72.

Next, it is judged whether the recording sheet R passed through the delivery sheet sensor SR is the final page (F59), and when it is not the final page, the delivery sheet counter is added by (+1) (F60), and the sequence returns to F51, and when it is the final page, it is judged whether it is the final volume (F61). Then, when it is judged that it is the final volume, the sheet feeding control of the sheet K ends (F62). On the one hand, in F61, when it is not the final volume, 1 is set to the delivery sheet counter (F63), and the sequence returns to F51.

Next, centering around the conveyance of the recording sheet R and the sheet K in the image forming system of the present embodiment, its operation will be described. FIG. 12 is a time chart of the image forming system in which an attention is paid to the conveyance of the recording sheet R and the sheet K, and it is a case in which the front sheet K1 and the rear sheet K3 are inserted into the 3 pages of recording sheets R1–R3, and the partition sheet K2 is inserted between the second page recording sheet R2 and the third page recording sheet R3, and a plurality of volumes of these sheets are made, and further, a case in which, after these sheets are staple processed by the staple means 82, these sheets are delivered onto the elevating delivery sheet tray 73. Further, it is a case in which the recording sheets R1–R3 are accommodated in the recording sheet accommodating means 41, and are fed by the first sheet feeding means. 51. Incidentally, the vertical axis and the horizontal axis in FIG. 12 are basically the same as in the above described FIG. 8. Incidentally, the horizontal lines c and g are expressed as the same position (the same distance from the joint position) for convenience sake, and the horizontal line i in FIG. 12 is a position of the conveyance roller 95. Further, FIG. 12 is written by neglecting the alignment operation of the recording sheet R or the sheet K on the stacking section 72.

Initially, when the job (image formation) is started, the first page recording sheet R1 is fed by the first sheet feeding means 51. Simultaneously with this, the image forming apparatus A outputs the sheet feeding command to the finishing apparatus FS. The finishing apparatus FS receives the sheet feed command, and sends out the sheet K (front sheet K1) accommodated in the sheet accommodating means 75 by the sheet supplying roller 94, and conveys it to the stacking section 72 by the conveyance rollers 95, 92 and 93. Herein, on the way in which the front sheet K1 is sent out by the sheet supplying roller 94, at the time point when the trailing edge of the front sheet K1 passes through the sheet sensor SK, the existence of the sheet K (partition sheet) succeeding to the front sheet K is confirmed, and it is outputted to the image forming apparatus A that there is a partition sheet K2 in the sheet accommodating means 75. Further, when it is detected that the front sheet K1 passes through the conveyance roller 95, the pre-feeding of the partition sheet K2, which is the next sheet K, is started. That is, the partition sheet K2 is sent out by the sheet supplying roller 94, and comes to the stopped condition by the conveyance roller 95. At this time, on the way in which the partition sheet K2 is pre-fed by the sheet supplying roller 94, at the time point when the trailing edge of the partition sheet K2 passes through the sheet sensor SK, the existence of the sheet K (rear sheet K3) succeeding to the partition sheet K2 is confirmed, and it is outputted to the image forming apparatus A that there is a rear sheet K3 in the sheet accommodating means 75. The front sheet K1 conveyed to the stacking section 72 is aligned by the regulation plate 721 in the direction perpendicular to the drawing.

On the one hand, the recording sheet R1 fed by the first sheet feeding means 51, is once stopped by the second sheet feeding means 55, and is in timed relationship with the toner image on the photoreceptor drum, and re-feeding is started, and the toner image is transferred onto the recording sheet R1, and the toner image is fixed in the fixing section 33, and the recording sheet R1 is delivered outside the image forming apparatus A. The delivered recording sheet R1 is sent into the finishing apparatus FS, and detected by the delivery sheet sensor SR, and conveyed onto the stacking section 72 (onto the front sheet K1) by the rollers 91–93, which are the first conveyance means.

After the first page recording sheet R1 is fed, the first sheet feeding means 51 feeds the second recording sheet R2 after a predetermined time L1. After the fed recording sheet R2 is stopped once by the second sheet feeding means 55, it is conveyed again, and the transferring of the toner image and the fixing is conducted on the recording sheet R2, and the recording sheet R2 is conveyed onto the stacking section 72 (onto the recording sheet R1), by the conveyance rollers 91–93.

Incidentally, in this case, because it is set that the partition sheet K2 is inserted between the recording sheet R2 and the recording sheet R3, when the second page recording sheet R2 is detected by the delivery sheet sensor SR, after a predetermined time (L7) is delayed, the finishing apparatus FS re-conveys the pre-fed partition sheet K2 by the conveyance roller 95, and conveys it to the stacking section 72 (onto the recording sheet R2) by the conveyance rollers 95, 92, and 93. Incidentally, in the predetermined time L7, the delay time is longer than a predetermined time L2 in FIG. 8, by a time period by the pre-feeding. When the partition sheet K2 is conveyed again, and it is detected that it passes through the conveyance roller 95, the pre-feeding of the rear sheet K3, which is the next sheet K, is started. That is, the rear sheet K3 is sent out by the sheet supplying roller 94, and is in the condition that the rear sheet K3 is stopped by the conveyance roller 95. At this time, on the way in which the rear sheet K3 is pre-fed by the sheet supplying roller 94, at the time point when the trailing edge of the rear sheet K3 passes through the sheet sensor SK, the existence of the sheet K (front sheet K1 of the next volume) succeeding to the rear sheet K3 is confirmed, and it is outputted to the image forming apparatus A that there is a front sheet K1 in the sheet accommodating means 75.

On the one hand, after the recording sheet R2 is fed, the first sheet feeding means 51 feeds the recording sheet R3, and in order to insert the partition sheet K2 between the recording sheet R2 and the recording sheet R3, the sheet feeding of the third page recording sheet R3 is started after a predetermined time L3 (L1×2) after the sheet feeding of the recording sheet R2. Then, the recording sheet R3, which is delayed and fed, is conveyed again after it is stopped once by the second sheet feeding means 55, in the same manner as described above, and the transferring of the toner image and fixing are conducted on the recording sheet R3, and it is conveyed to the stacking section 72 (onto the partition sheet K2) by the conveyance rollers 91–93.

Incidentally, in this case, because it is set that the rear sheet K3 is inserted after the recording sheet R3, which is the final page sheet, when the third page recording sheet R3 is detected by the delivery sheet sensor SR, after a predetermined time (L7) is delayed, the finishing apparatus FS re-conveys the pre-fed rear sheet K3 by the conveyance roller 95, and conveys it to the stacking section 72 (onto the recording sheet R3) by the conveyance rollers 92 and 93. In the same manner as described above, the pre-feeding of the front sheet K1 is conducted, and further, the existence of the next sheet K (partition sheet K2) is outputted to the image forming apparatus A.

When the front sheet K1, recording sheets R1 and R2, partition sheet K2, recording sheet R3, and rear sheet K3 are stacked on the stacking section 72, the staple processing (finishing) by the staple means 82 is conducted, and then, the sheets are delivered onto the elevating delivery sheet tray 73, and the first volume is completed.

Incidentally, after the third page recording sheet R3 of the first volume is fed by the first sheet feeding means 51, because setting of the rear sheet K3, finishing, the front sheet K1 of the second volume, is made, after a predetermined time in which the delay for the rear sheet K3 insertion, delay for the finishing, and delay for the front sheet K1 insertion are summed up, because it is previously noticed that there is a sheet K1, the sheet feeding of the first page recording sheet R1 of the second volume by the first sheet feeding means 51 is started. Then, simultaneously with this, the sheet feeding command of the front sheet K1 is outputted to the finishing apparatus FS, and after a predetermined time (L8) passes, the front sheet K1, which is pre-fed, is conveyed again. The description following that is the same as the case of the first volume, therefore, the explanation will be neglected.

As described above, in the present embodiment, the sheet K is previously sent out (pre-feeding), thereby, it is confirmed in early stage, whether the next sheet K succeeding to the sent out sheet k exists, and the conveyance interval of the recording sheet is decreased, and the image forming efficiency can be increased. Specifically, the time interval between the final page recording sheet R3 of the first volume and the first page recording sheet R1 of the second volume, is more reduced, as compared to the case in which the pre-feeding is not conducted (shown by a dotted line in FIG. 12), as shown by a white arrow, thereby, the efficiency can be increased.

(4) Embodiment 4

Figure 13:
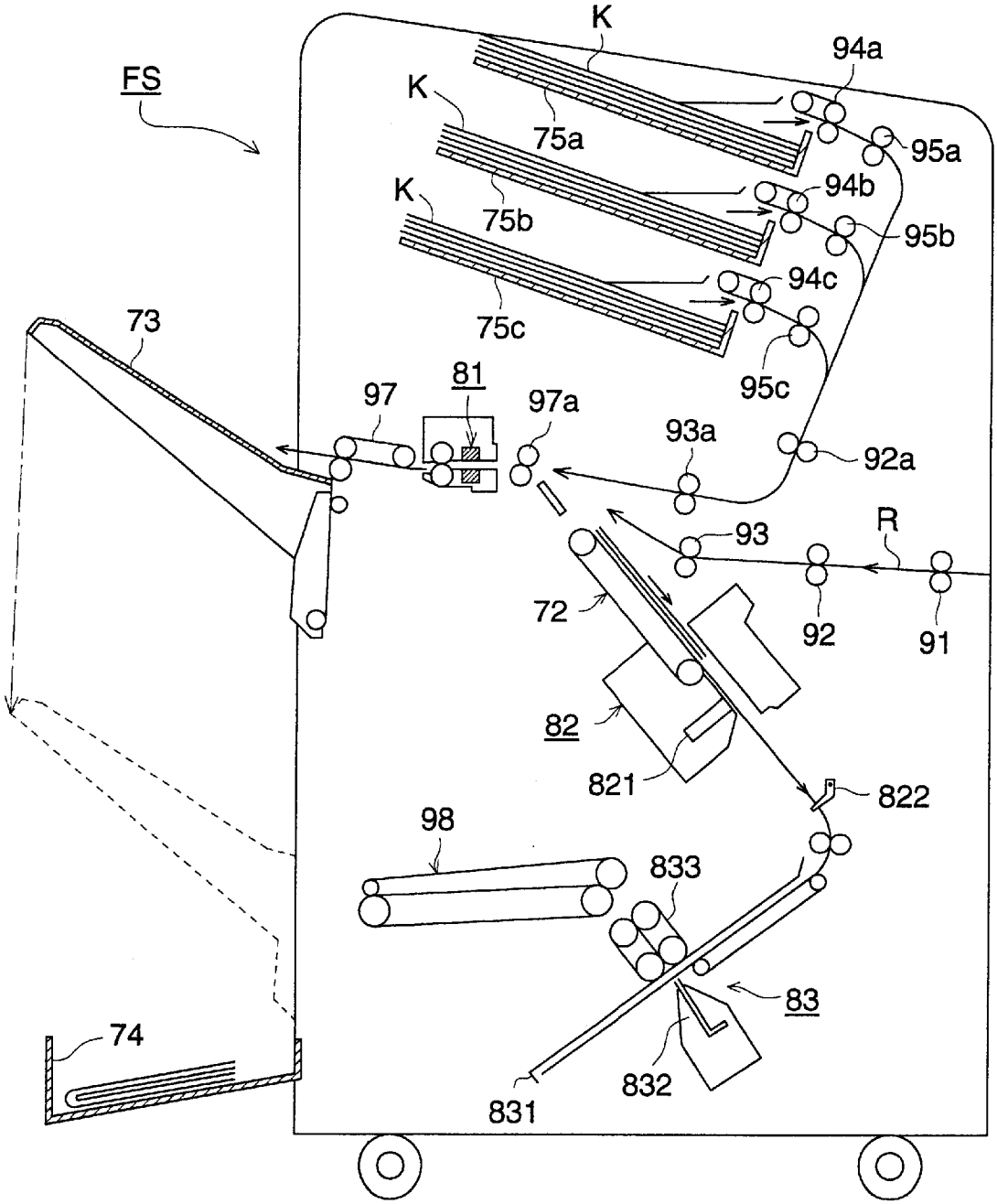
FIG. 13 is a sectional view of the finishing apparatus according to Embodiment 4.

Next, according to FIG. 13, which is a sectional view of the finishing apparatus, Embodiment 4 will be described. Incidentally, in FIG. 13, the same structures as in the above described embodiments 1–3 are denoted by the same numerals and signs, and their explanation will be sometimes neglected. The different points will be mainly described below. Further, in FIG. 13, the image forming apparatus A is neglected, however, in the same manner as in FIG. 1, it is connected toward the right direction in FIG. 13.

In the above described embodiments 1–3, the finishing apparatus FS has one sheet accommodating means 75 for accommodating the sheet K, however, in the present embodiment, the finishing apparatus FS has a plurality of (three) sheet accommodating means 75*a*–75*c*. Further, corresponding respectively to a plurality of sheet accommodating means 75*a*–75*c*, the finishing apparatus FS has the sheet supplying rollers 94*a*–94*c* to send out the sheet K accommodated in the sheet accommodating means 75*a*–75*c* one by one sheet. Further, in the present embodiment, the finishing apparatus FS has the conveyance rollers 95*a*–95*c* to respectively convey the sheet K sent out by the sheet supplying rollers 94*a*–94*c*. Then, the sheet K conveyed by the conveyance rollers 95*a*–95*c* is conveyed onto the stacking section 72 by the conveyance rollers 92*a* and 93*a*.

Further, in the above described embodiments 1–3, a part of conveyance rollers, that is, 92 and 93, are commonly used for the first conveyance means 91–93 for conveying the recording sheet R, and the second conveyance means 92–95 for conveying the sheet K, however, in the present embodiment, the first conveyance means 91–93, and the second conveyance means 94*a*–94*c*, 95*a*–95*c*, 92*a*, and 93*a*, are independent of each other, and the conveyance path of the recording sheet R by the first conveyance means 91–93, is different from the conveyance path of the sheet K by the second conveyance means 94*a*–94*c*, 95*a*–95*c*, 92*a*, and 93*a*.

Herein, in the case where, by using the finishing apparatus FS, the sheet K is inserted into the recording sheet R, and sheets are stapled, its operation will be described below. After the recording sheet R is image-formed by the image forming apparatus A, and delivered, it is conveyed by the conveyance rollers 91–93, and when the trailing edge of the recording sheet R passes through the conveyance roller 93, it drops above the stacking section 72, and comes into contact with the stopper 821, and is stopped.

On the one hand, the sheet K is sent from any one of sheet supplying rollers 94*a*–94*c*, and conveyed by corresponding conveyance roller (any one of 95*a*–95*c*). In this case, any one of the sheet accommodating means 75*a*–75*c* is specified by the operation section FP of the finishing apparatus FS or the operation section AP of the image forming apparatus, and according to this designation, any one of the sheet supplying rollers 94*a*–94*c*, and conveyance rollers 95*a*–95*c* is selected, and driven. This control to convey the sheet K is conducted by the finishing control means AC. Incidentally, the designation by the operation sections FP and AP may also directly select any one of the sheet accommodating means 75*a*–75*c*, or may also specify the size or kind of the sheet. In this case, the size detection means or sheet kind detection means may also be provided in respective sheet accommodating means 75*a*–75*c*, or the size or kind of the accommodated sheets may also be registered previously from the operation sections FP and AP. Further, the sheet accommodating means 75*a*–75*c* are respectively provided for the front sheet, partition sheet, and rear sheet, and according to the setting by the operation sections FP and AP, respective sheet may also be conveyed.

The sheet K conveyed by the sheet supplying rollers 94*a*–94*c*, and conveyance rollers 95*a*–95*c*, passes through the conveyance rollers 92*a* and 93*a,* and when the trailing edge of the sheet K passes through the conveyance roller 93*a,* the sheet K drops above the stacking section 72, and comes into contact with the stopper 821 and stops.

After the recording sheet R and the sheet K stacked on the stacking section 72 are staple processed by the staple means 82, the staple processed bundle is conveyed upward by the stacking section 72, and delivered onto the elevating delivery sheet tray 73 through the conveyance roller 97*a*, shift processing means 81, and elevating delivery sheet roller 97*a.*

As described above, in the present embodiment, because the finishing apparatus FS has a plurality of sheet accommodating means 75*a*–75*c*, the sheets K whose sizes and kinds are different, can be accommodated in respective sheet accommodating means, thereby, the operability is increased.

Further, in the present embodiment, because the conveyance path by the first conveyance means 91–93 for conveying the recording sheet R is different from the conveyance path by the second conveyance means 94*a*–94*c*, 95*a*–95*c*, 92*a*, and 93*a* for conveying the sheet K, when the sheet K is inserted, it is not necessary that the interval of the recording sheet R is increased, as in the above described embodiments 1–3. Accordingly, not only the image forming apparatus A can convey the recording sheet R at the constant recording sheet interval, independently of the insertion of the sheet K in the finishing apparatus FS, but the productivity of the image formation is also greatly increased.

With the structures of the present invention, a finishing apparatus and an image forming system having a high reliability and a high usability and adaptability for a serial system for image formation and finishing can be provided.

According to the invention, the sheet can be inserted at not only the top and bottom side of the bundle of recording sheets, but also selectively into a middle point of the bundle of recording sheets. Further, the setting for the sheet insertion can be conducted at the finishing apparatus, the capability of the finishing apparatus can be enhanced, the setting work can be simplified, and operability can be enhanced.

Further, for example, if the image forming system is structured such that the sheet insertion can be set at the input section of the image forming system where various functions are set, the setting for various processes can be conducted in a concentrated manner at the same place and an operability can be enhanced.

Further, according to the invention, the conveyance of the recording sheet and the sheet in the finishing apparatus is stably conducted, thereby, the conveyance failure of the recording sheet and the sheet, or jamming in the finishing apparatus can be prevented.

Further, according to the invention, because the re-conveyance is conducted after the sheet to be inserted into the recording sheets is previously conveyed, the reliability of the sheet conveyance is increased. Further, the confirmation of the next sheet can be conducted early, thereby, the interval between the recording sheet and the recording sheet can be decreased, and the image formation efficiency is increased.

Further, according to the invention, when the sheets are exhausted, recording without the sheets is prevented from occurring.

Further, according to the invention, in the case where the sheets are exhausted when a sheet is to be inserted into the recording sheets, recording without the sheet is prevented from occurring.

Further, according to the invention, because the sheet feeding and image formation for the recording sheets are started, after the next sheet is confirmed, there is no case where recording without the sheet occurs.

Further, according to the invention, a sheet which does not conform to the size of the recording sheets is prevented from being attached to the recording sheets.

Further, according to the invention, a sheet which does not conform to the size or the kind of the specified sheet is prevented from being attached to the recording sheets.

Further, according to the invention, when the sheet is inserted, it is not necessary that the interval between recording sheets is increased, and as a result, the image formation efficiency is prevented from being lowered.

Further, according to the invention, various sheets can be used for the-front sheet, partition sheet, and rear sheet.

What is claimed is:

1. A recording sheet feeding method, wherein images are sequentially formed on recording sheets including a first recording sheet and a second recording sheet fed by a sheet feeder and wherein the recording sheets on which the images have been formed are conveyed so as to be stacked on a stacker of a finishing apparatus, the feeding method comprising:

feeding the recording sheets from a recording sheet accommodating device for accommodating the recording sheets to a temporary stop position in a recording sheet conveying path;

re-feeding, after a temporary stop, the recording sheets fed from the recording sheet accommodating device, in a manner so that when a sheet is inserted between the first recording sheet and the second recording sheet, a re-feeding interval between the first and second recording sheets is made larger than a re-feeding interval between respective other recording sheets when the sheet is not inserted between the respective other recording sheets, and inserting the sheet between the first and second recording sheets on the stacker.

2. The recording sheet feeding method described in claim 1, wherein, when the second recording sheet is fed after the first recording sheet and the re-feeding interval between the first and second sheets is increased, re-feeding of the second recording sheet is delayed by a predetermined time period.

3. An image forming system comprising:

(i) an image forming apparatus having:

a recording sheet accommodating device for accommodating recording sheets including a first recording sheet and a second recording sheet;

a first sheet feeder for feeding the recording sheets;

a second sheet feeder for conveying the recording sheets fed from the first sheet feeder;

an image forming device for forming images on the recording sheets conveyed by the second sheet feeder; and (ii) a finishing apparatus having:

a stacker for stacking the recording sheets;

a first conveyor for conveying the recording sheets from the image forming apparatus to the stacker;

a sheet accommodating device for accommodating a sheet to be inserted at an insertion position, said insertion position being at least one of a top of the recording sheets, a bottom of the recording sheets, and a middle position between the recording sheets;

a second conveyor for conveying the sheet accommodated in the sheet accommodating device to the stacker;

a primary controller for controlling the first sheet feeder and the second sheet feeder so that when the sheet is to be inserted between the first recording sheet and the second recording sheet, the second sheet feeder makes a feeding interval between the first and second recording sheets larger than a feeding interval between respective other recording sheets when the sheet is not inserted between the respective other recording sheets; and a finishing controller for, when the sheet is to be inserted between the first recording sheet and the second recording sheet, controlling the second conveyor so that the sheet is inserted between the first and second recording sheets in the stacker.

4. The image forming system described in claim 3, wherein when the second recording sheet is fed after the first recording sheet and the feeding interval between the first and second recording sheets is increased, the primary controller controls the second sheet feeder so as to delay conveying the second recording sheet by a predetermined time period.

5. A finishing apparatus, comprising:

a stacker for stacking recording sheets;

a first conveyor for conveying the recording sheets from an image forming apparatus to the stacker;

a sheet accommodating device for accommodating a sheet to be inserted at an insertion position, said insertion position being at least one of a top of the recording sheets, a bottom of the recording sheets, and a middle position between the recording sheets;

a second conveyor for conveying the sheet accommodated in the sheet accommodating device to the stacker, the second conveyor comprising a sheet supplier for feeding the sheet out from the sheet accommodating device and a re-conveyor for re-conveying the sheet fed out by the sheet supplier; and a finishing controller for controlling the second conveyor so that the sheet fed out from the sheet supplier is stopped and thereafter re-conveyed by the re-conveyor.

6. The finishing apparatus described in claim 5, wherein the finishing controller controls the re-conveyor so as to conduct re-conveyance based on at least one of conveyance information from the first conveyor delivery information from the image forming apparatus.

* * * * *